US009771734B2

(12) United States Patent
Odegard et al.

(10) Patent No.: US 9,771,734 B2
(45) Date of Patent: Sep. 26, 2017

(54) POLE REINFORCEMENT SYSTEM

(71) Applicant: PermaPole LLC, Fargo, ND (US)

(72) Inventors: Bradley A. Odegard, Fargo, ND (US); William Riddle, Livingston, MT (US); Douglas S. Cairns, Bozeman, MT (US); Robert P. Plagemann, Fargo, ND (US)

(73) Assignee: Permapole LLC, Fargo, ND (US)

( * ) Notice: Subject to any disclaimer, the term of this patent is extended or adjusted under 35 U.S.C. 154(b) by 202 days.

(21) Appl. No.: 14/843,136

(22) Filed: Sep. 2, 2015

(65) Prior Publication Data

US 2016/0060892 A1 Mar. 3, 2016

Related U.S. Application Data

(60) Provisional application No. 62/045,435, filed on Sep. 3, 2014.

(51) Int. Cl.
*E04H 12/22* (2006.01)

(52) U.S. Cl.
CPC ..... *E04H 12/2292* (2013.01)

(58) Field of Classification Search
CPC . E04H 12/22; E04H 12/2215; E04H 12/2292; E04H 12/00; E02D 5/80
See application file for complete search history.

(56) References Cited

U.S. PATENT DOCUMENTS 405,658 A * 6/1889 Campany ..... E04H 12/2292 52/170
574,641 A 1/1897 Streator
844,726 A 2/1907 Hunter
877,268 A * 1/1908 Van Buren ..... E04H 12/2215 52/165
1,244,119 A * 10/1917 Mullnix ..... E04H 12/2292 405/216
1,755,461 A * 4/1930 Spring ..... E04H 12/2292 52/170
1,789,393 A * 1/1931 Spring ..... E04H 12/2292 52/170
3,350,822 A * 11/1967 Nachazel ..... E04H 12/04 173/132
3,738,072 A 6/1973 Adrian
3,785,107 A * 1/1974 Garretson ..... E04H 12/2292 256/59
4,312,162 A 1/1982 Medney
4,598,512 A * 7/1986 Chapman ..... E04H 12/2292 405/232
4,697,396 A 10/1987 Knight
(Continued)

*Primary Examiner* — Jessica Laux
(74) *Attorney, Agent, or Firm* — Fredrikson & Byron, P.A.

(57) ABSTRACT

A pole reinforcement system for improving the stability of a pole with both an above-grade and below-grade installation. The pole reinforcement system generally includes a sleeve assembly which is secured around a pole via one or more retainers which may comprise brackets, securing bands, or other structures. One or more insertion attachments are utilized so that the sleeve assembly may be secured to the pole at a position below-grade. The sleeve assembly may comprise one or more sleeves which are secured around the pole. By utilizing the present invention to reinforce the pole both above- and below-grade, the stability of the pole may be greatly improved over prior reinforcement methods.

27 Claims, 22 Drawing Sheets

(56) References Cited

U.S. PATENT DOCUMENTS

| | | | | |
|---|---|---|---|---|
| 4,756,130 | A | 7/1988 | Burtelson | |
| 4,779,389 | A | 10/1988 | Landers | |
| 5,345,732 | A * | 9/1994 | Knight | E04H 12/2292 52/153 |
| 6,079,165 | A | 6/2000 | Bingel, III | |
| 6,901,717 | B2 | 6/2005 | Brunozzi | |
| 7,168,220 | B2 | 1/2007 | Owoe | |
| 7,363,752 | B2 | 4/2008 | Bingel, III | |
| 7,415,808 | B2 | 8/2008 | Bingel, III | |
| 7,815,157 | B2 | 10/2010 | Knight | |
| 9,657,493 | B2 * | 5/2017 | Finnegan | E04H 12/2292 |
| 2004/0134161 | A1 | 7/2004 | Lockwood | |
| 2005/0108979 | A1 | 5/2005 | Yttrup | |
| 2005/0210821 | A1 | 9/2005 | Bingel, III | |
| 2005/0211454 | A1 | 9/2005 | Bingel, III | |
| 2007/0256388 | A1 | 11/2007 | Ianello | |
| 2009/0152434 | A1 | 6/2009 | Knight | |
| 2009/0266026 | A1 | 10/2009 | Hannay | |
| 2012/0131864 | A1 | 5/2012 | Blaylock | |
| 2013/0084433 | A1 | 4/2013 | Ernst | |

* cited by examiner

POLE REINFORCEMENT SYSTEM

CROSS REFERENCE TO RELATED APPLICATIONS

I hereby claim benefit under Title 35, United States Code, Section 119(e) of U.S. provisional patent application Ser. No. 62/045,435 filed Sep. 3, 2014. The 62/045,435 application is hereby incorporated by reference into this application.

STATEMENT REGARDING FEDERALLY SPONSORED RESEARCH OR DEVELOPMENT

Not applicable to this application.

BACKGROUND OF THE INVENTION

Field of the Invention

The present invention relates generally to pole reinforcement and more specifically it relates to a pole reinforcement system for improving the stability of a pole with both an above-grade and below-grade installation.

Description of the Related Art

Any discussion of the related art throughout the specification should in no way be considered as an admission that such related art is widely known or forms part of common general knowledge in the field.

Poles and the like are used throughout the world for various purposes, such as to support telephone lines, power lines, street lamps, fences, and the like. It is important to properly reinforce a pole, or the pole may become structurally damaged, warped, or even fall over due to inclement weather or blunt force contact (such as with a vehicle). Previous methods of installation have generally consisted of either reinforcement which is limited to the above-grade portions of the pole or above- and below-grade reinforcements that require significant effort and excavation to install.

Poles are often made of wood due to its wide availability throughout the world. While wood is suitable for use with poles for many purposes, it can often rot (particularly at or below ground level). Further, all poles, and particularly those made of wood, may be damaged by wind or other weather elements which can lead to warping and breakage. Without reinforcement, poles will often suffer from failure in some regard and need to be replaced or fixed.

Poles generally deteriorate beyond an acceptable level at the ground level in advance of pole failure. Pole replacement after such a failure is neither easy nor economical. It can be costly and time-consuming, as well as requiring interruption of service to customers. Current solutions for reinforcing poles are heavy, do not precisely match the mechanical properties of the pole, and are subject to corrosion. They are also prohibitively expensive in many cases and require a multi-step installation process which further requires the use of additional equipment and trained personnel.

Because of the inherent problems with the related art, there is a need for a new and improved pole reinforcement system for improving the stability of a pole with both an above-grade and below-grade installation in a simple and efficient manner.

BRIEF SUMMARY OF THE INVENTION

Provided herein is a reinforcement system which includes a sleeve assembly which is secured around a pole via one or more retainers which may comprise brackets, securing bands, or other structures. One or more insertion attachments are utilized so that the sleeve assembly may be secured around the pole at a position below-grade. The sleeve assembly may comprise one or more sleeves which are secured around the pole. By utilizing the present invention to reinforce the pole both above- and below-grade, the stability of the pole may be greatly improved over prior reinforcement methods.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
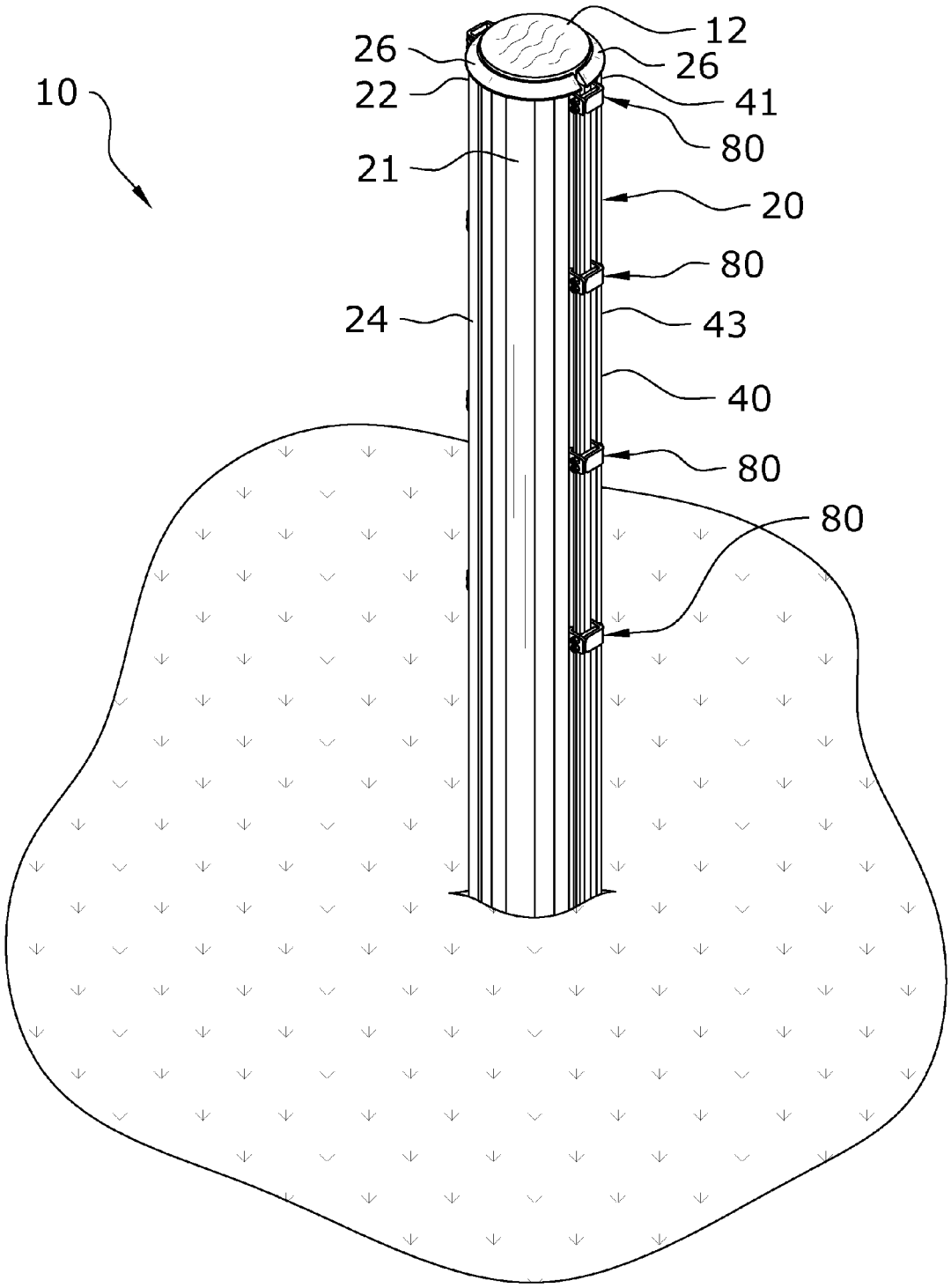
FIG. 1 is an upper perspective view of the present invention installed to reinforce a pole which is installed in the ground.

Turning now descriptively to the drawings, in which similar reference characters denote similar elements throughout the several views, FIGS. 1 through 26 illustrate a pole reinforcement system 10, which comprises a sleeve assembly 20 which is secured around a pole 12 via one or more retainers 80 which may comprise brackets 81, 82, securing bands 88, or other structures. One or more insertion attachments 60, 70 are utilized so that the sleeve assembly 20 may be positioned around the pole below-grade. Each of the insertion attachments 60, 70 may include a blade 61, 71 which aids with installation of the present invention below-grade. The sleeve assembly 20 may comprise one or more sleeves 21, 40 and which is secured around the pole 12.

By utilizing the present invention to reinforce the pole 12 both above- and below-grade, the stability of the pole 12 may be greatly improved over prior reinforcement methods. While the present application utilizes the term "pole", it should be appreciated that any elongated support structure, whether supported within the ground or any other surface, could benefit from the reinforcement provided by the present invention. Such elongated structures are often used to support telephone lines, power lines, street lamps, fences, and the like. Benefits gained from usage of the present invention include better reinforcement against wind and other elements as well as prevention of rot or warping due to repeated contact with water or other wet substances. Thus, the present invention should not be improperly construed as being limited to any particular type of post, pole, or the like.

B. Sleeves

Figure 3:
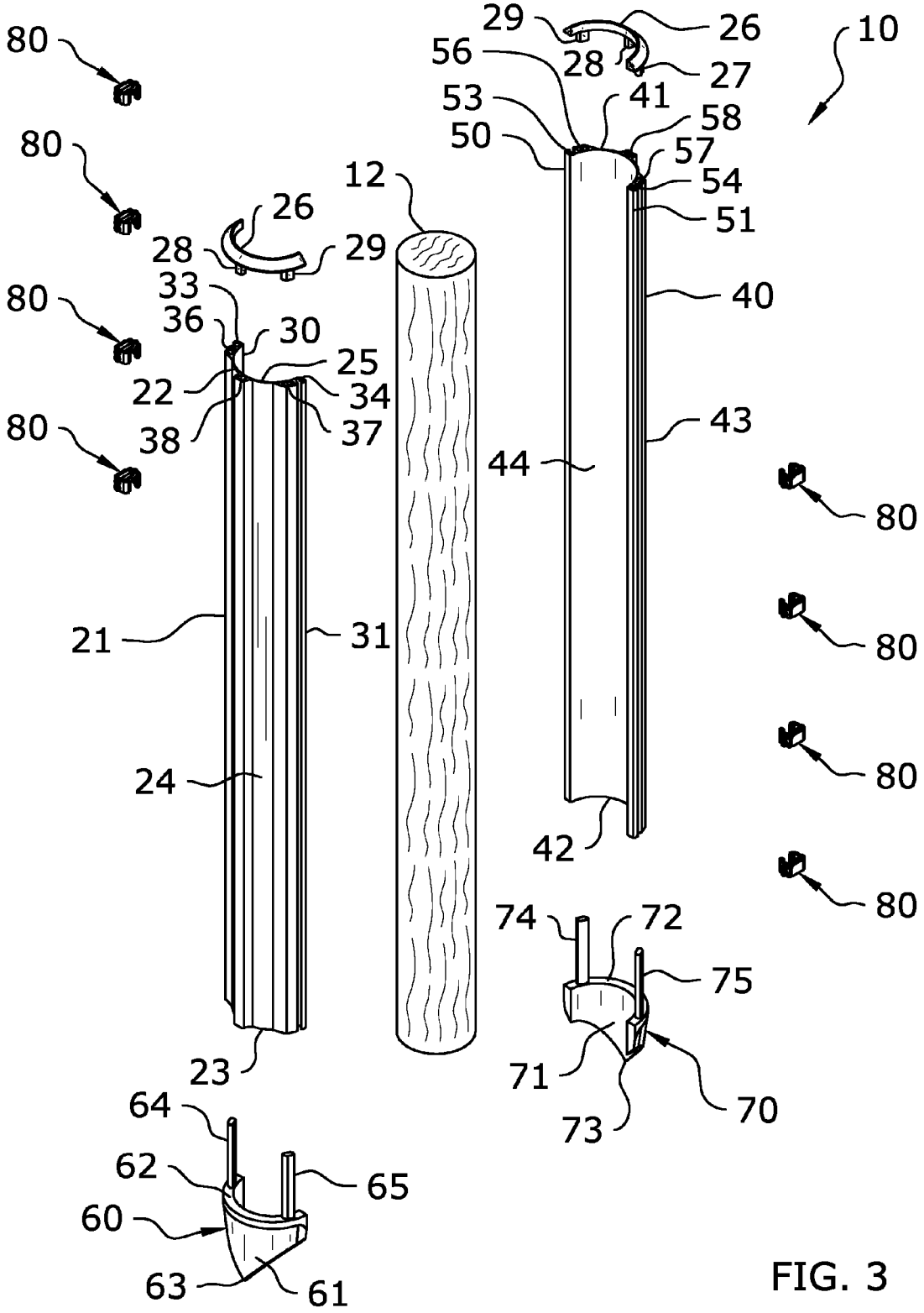
FIG. 3 is an exploded upper perspective view of the present invention.
Figure 13:
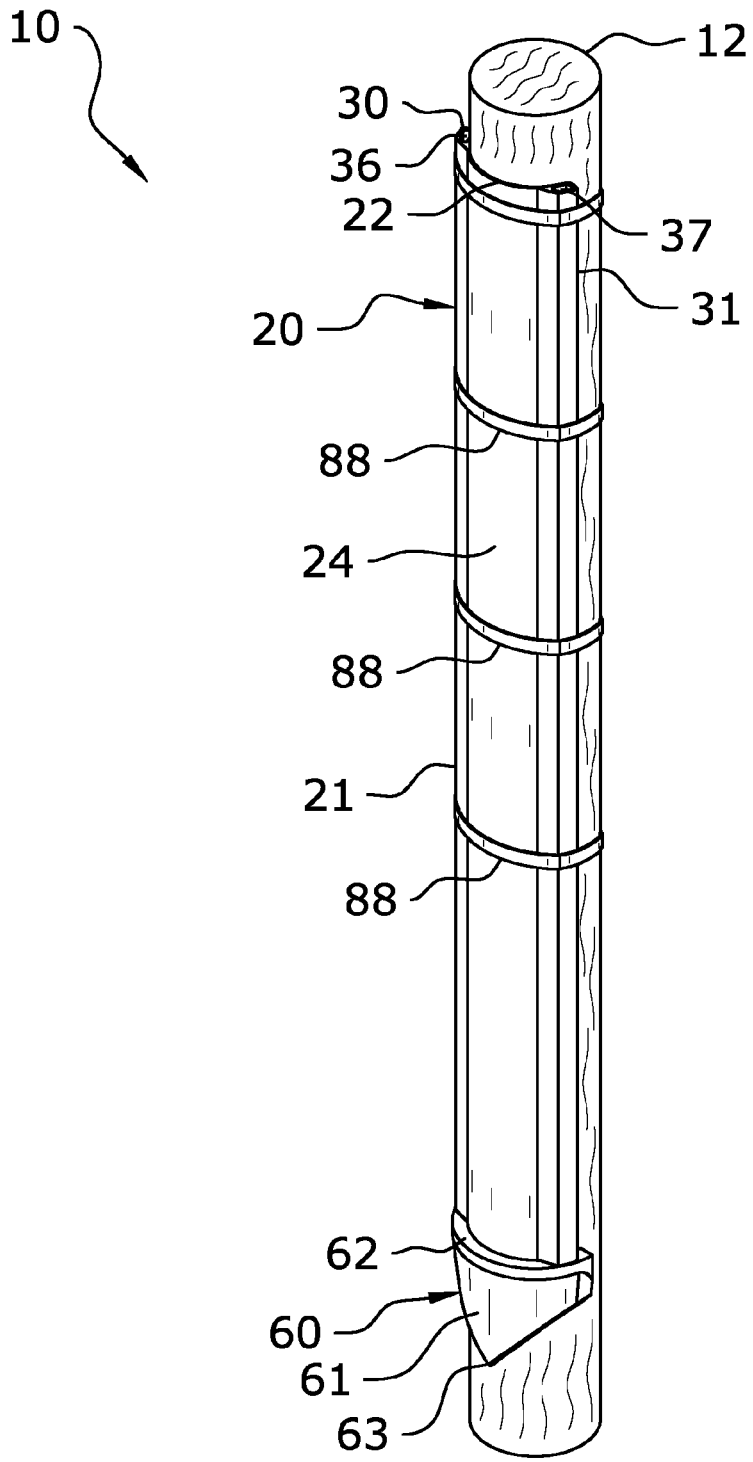
FIG. 13 is an upper perspective view of an alternate retainer being used with a one-sleeve embodiment of the present invention.
Figure 14:
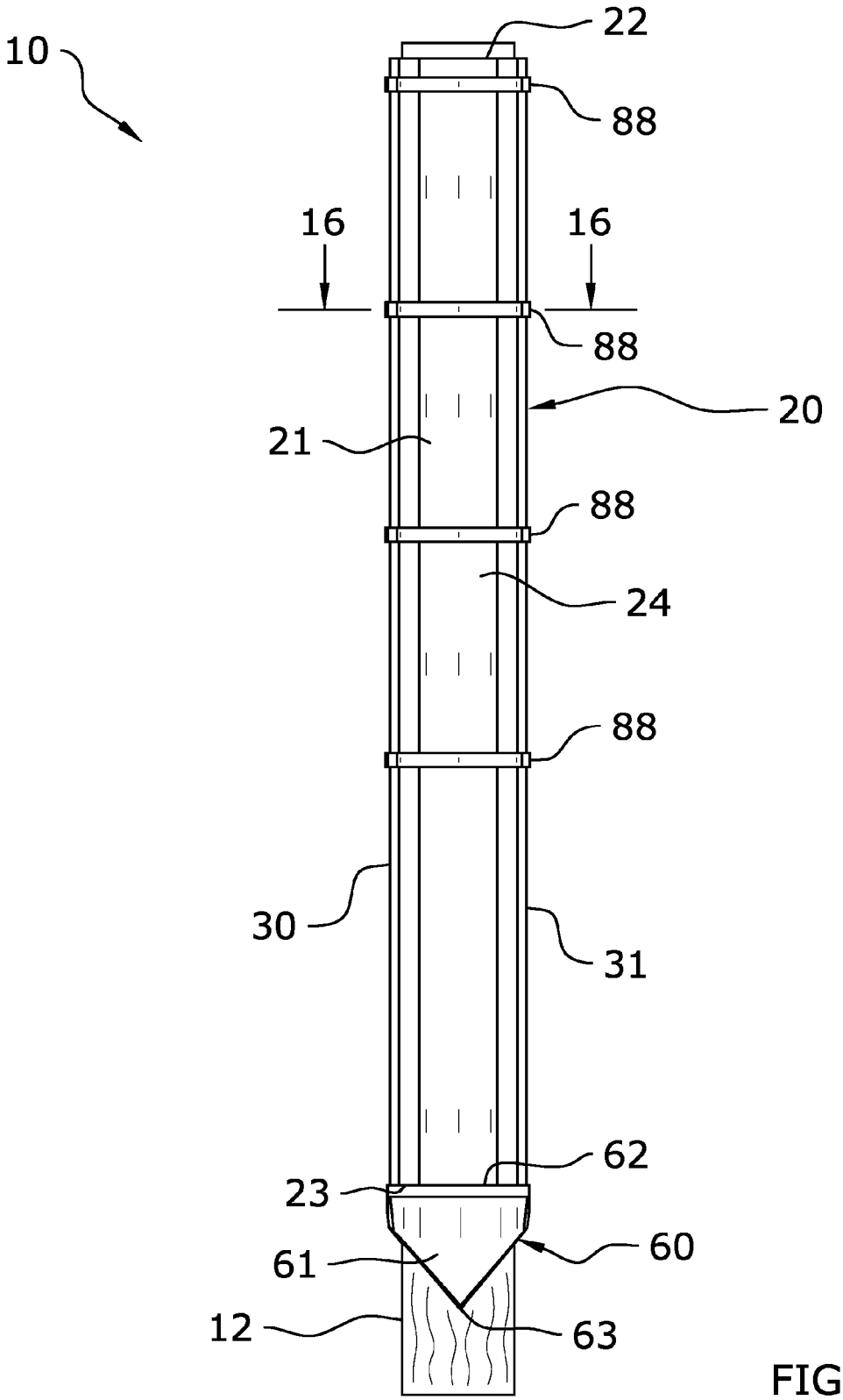
FIG. 14 is a frontal view of an alternate retainer being used on the present invention.
Figure 15:
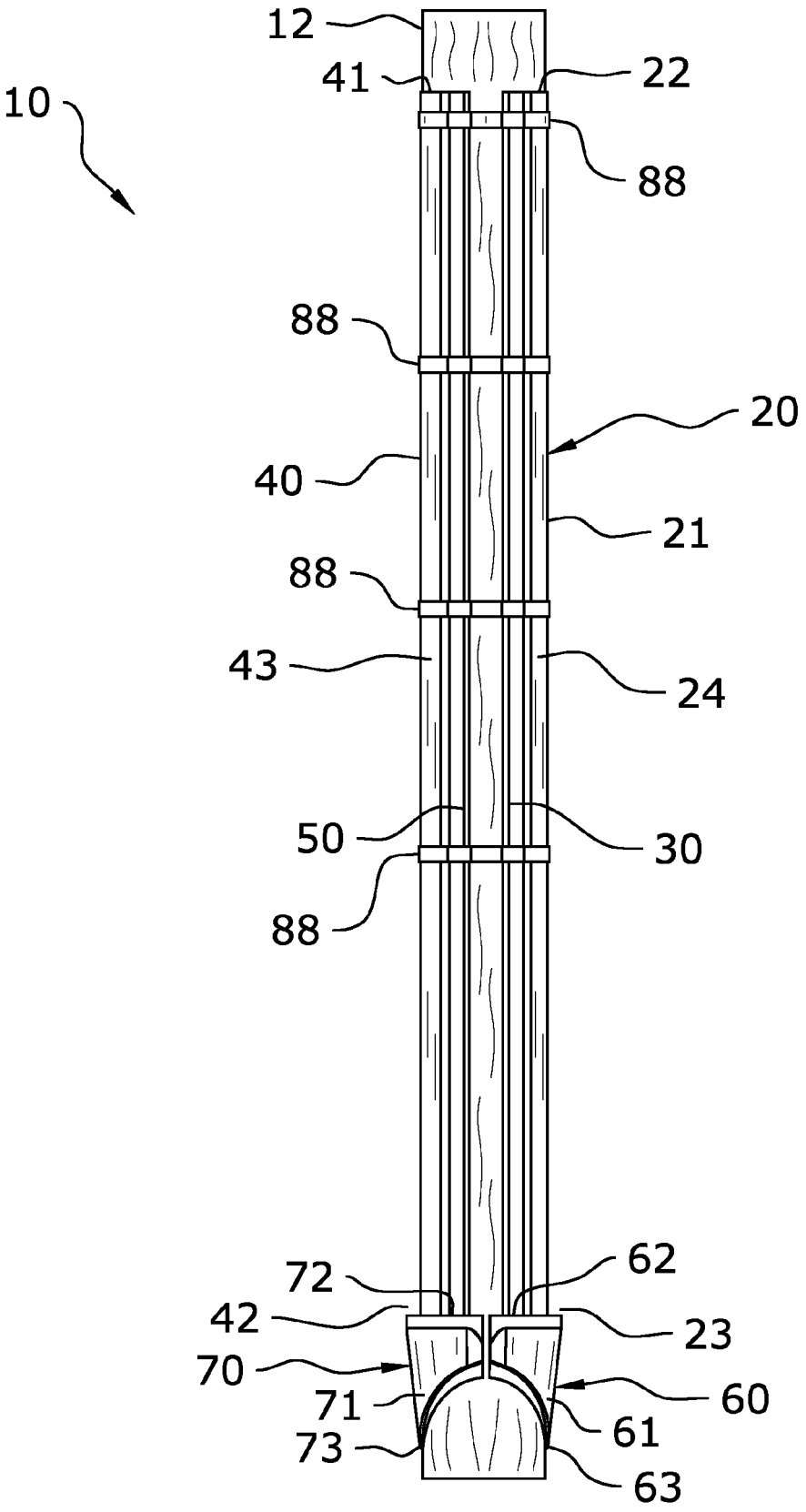
FIG. 15 is a side view of an alternate retainer being used on the present invention.
Figure 16:
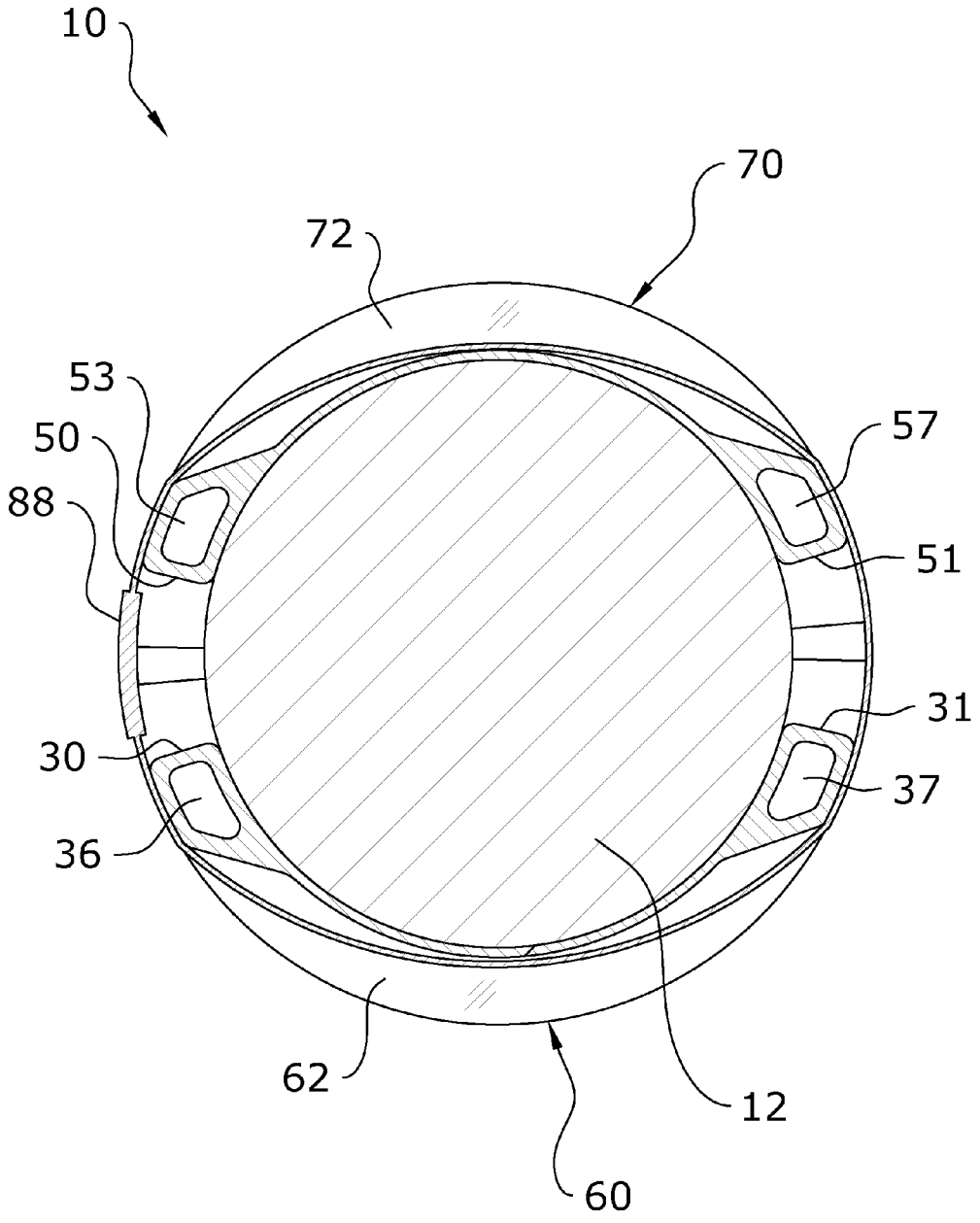
FIG. 16 is a top sectional view of an alternate retainer being used on the present invention.
Figure 17:
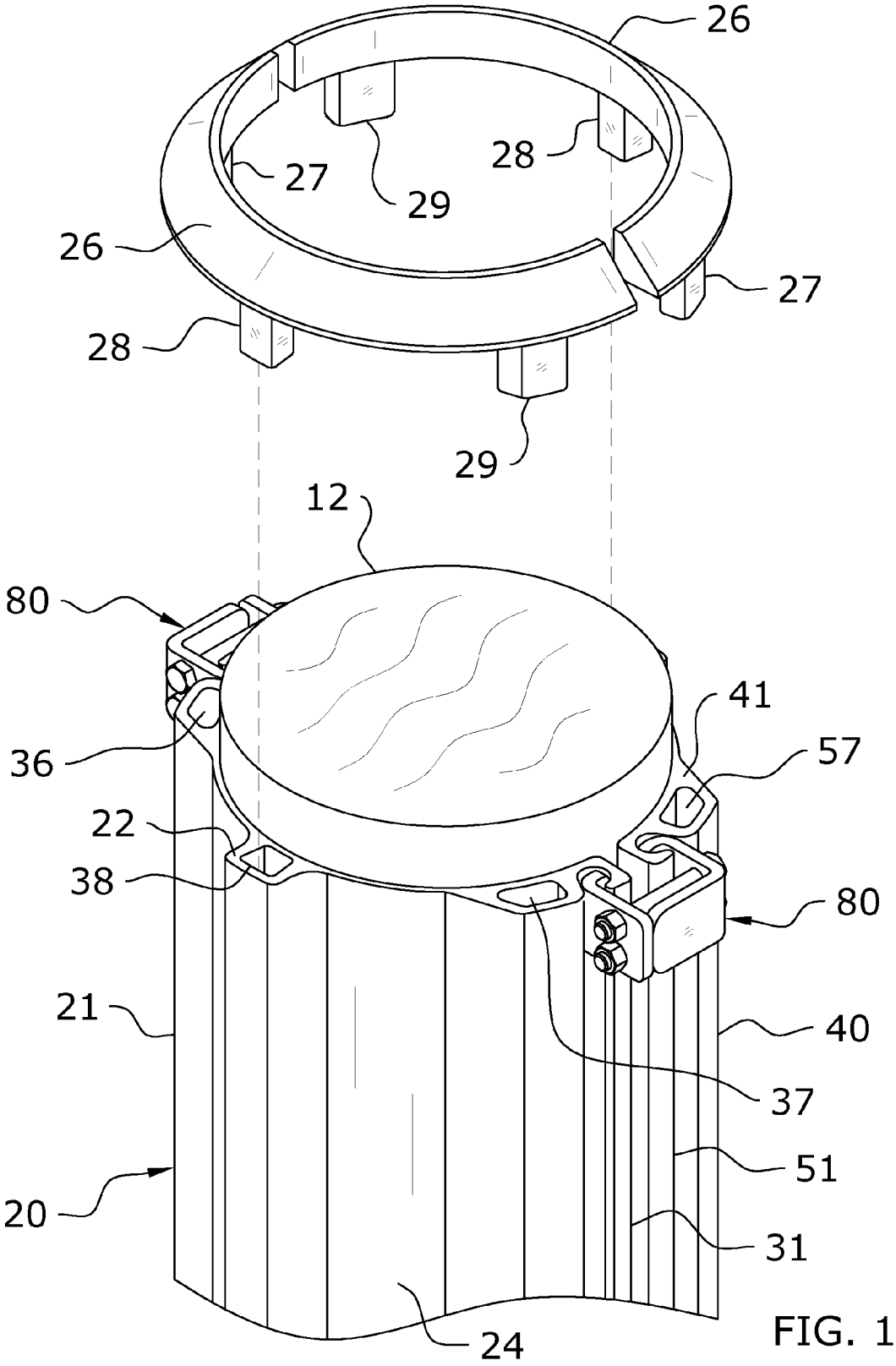
FIG. 17 is an upper perspective view of a sleeve cap being lowered onto the present invention.
Figure 18:
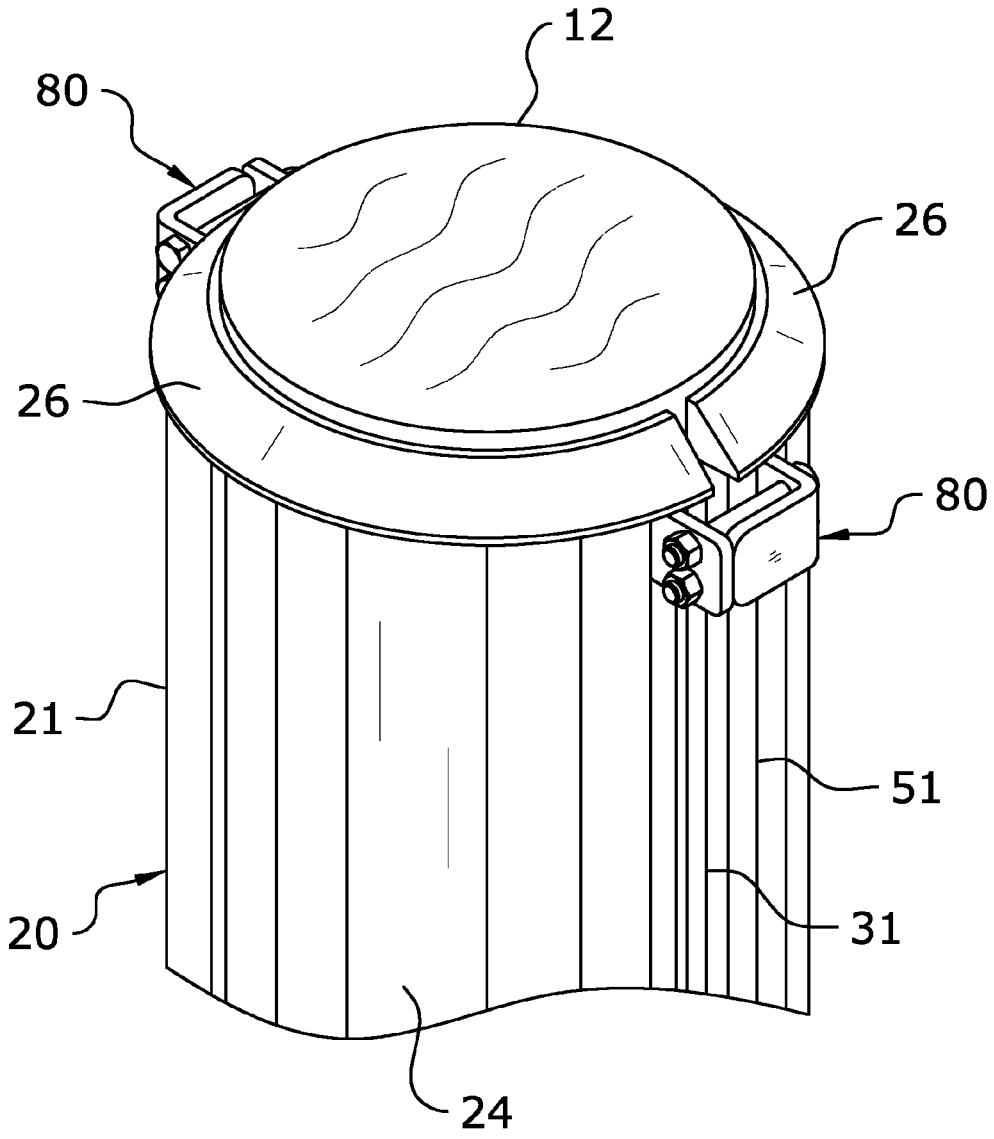
FIG. 18 is an upper perspective view of a sleeve cap installed onto the present invention.
Figure 19:
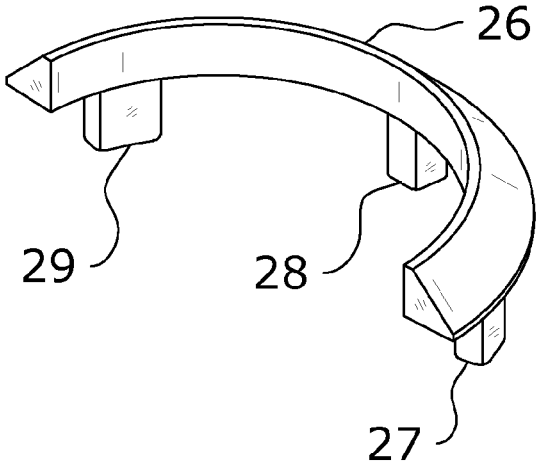
FIG. 19 is an upper perspective view of a sleeve cap of the present invention.
Figure 20:
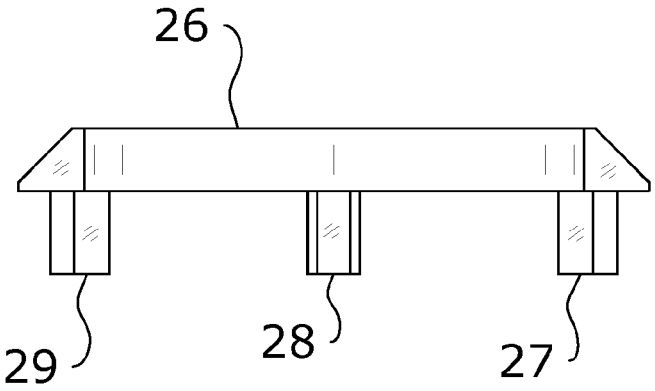
FIG. 20 is a frontal view of a sleeve cap of the present invention.
Figure 21:
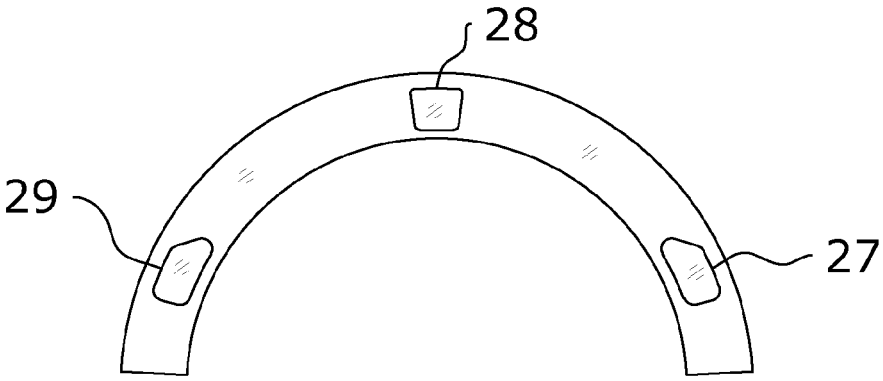
FIG. 21 is a top view of a sleeve cap of the present invention.
Figure 22:
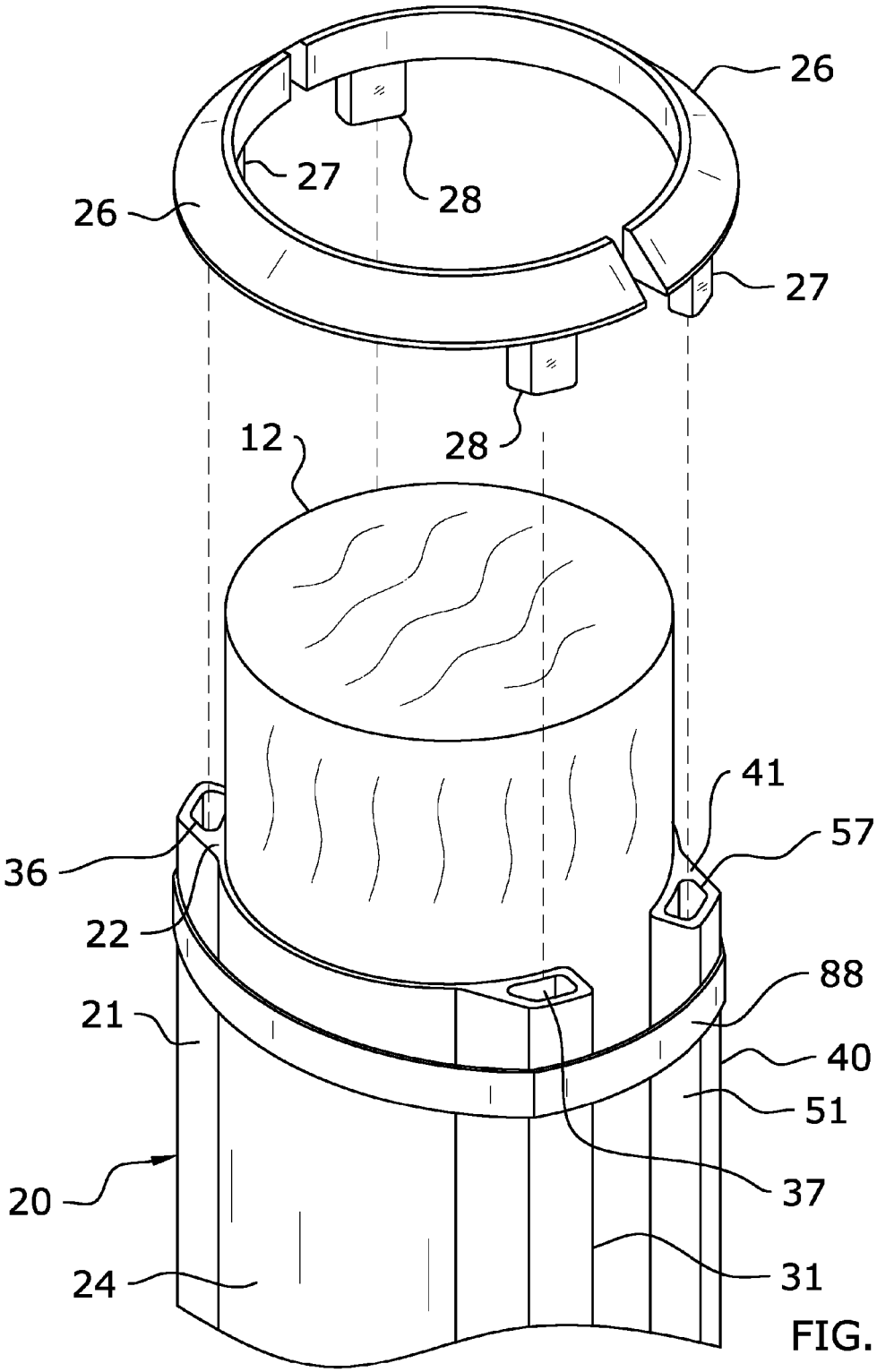
FIG. 22 is an upper perspective view of an alternate sleeve cap being lowered onto the present invention.
Figure 23:
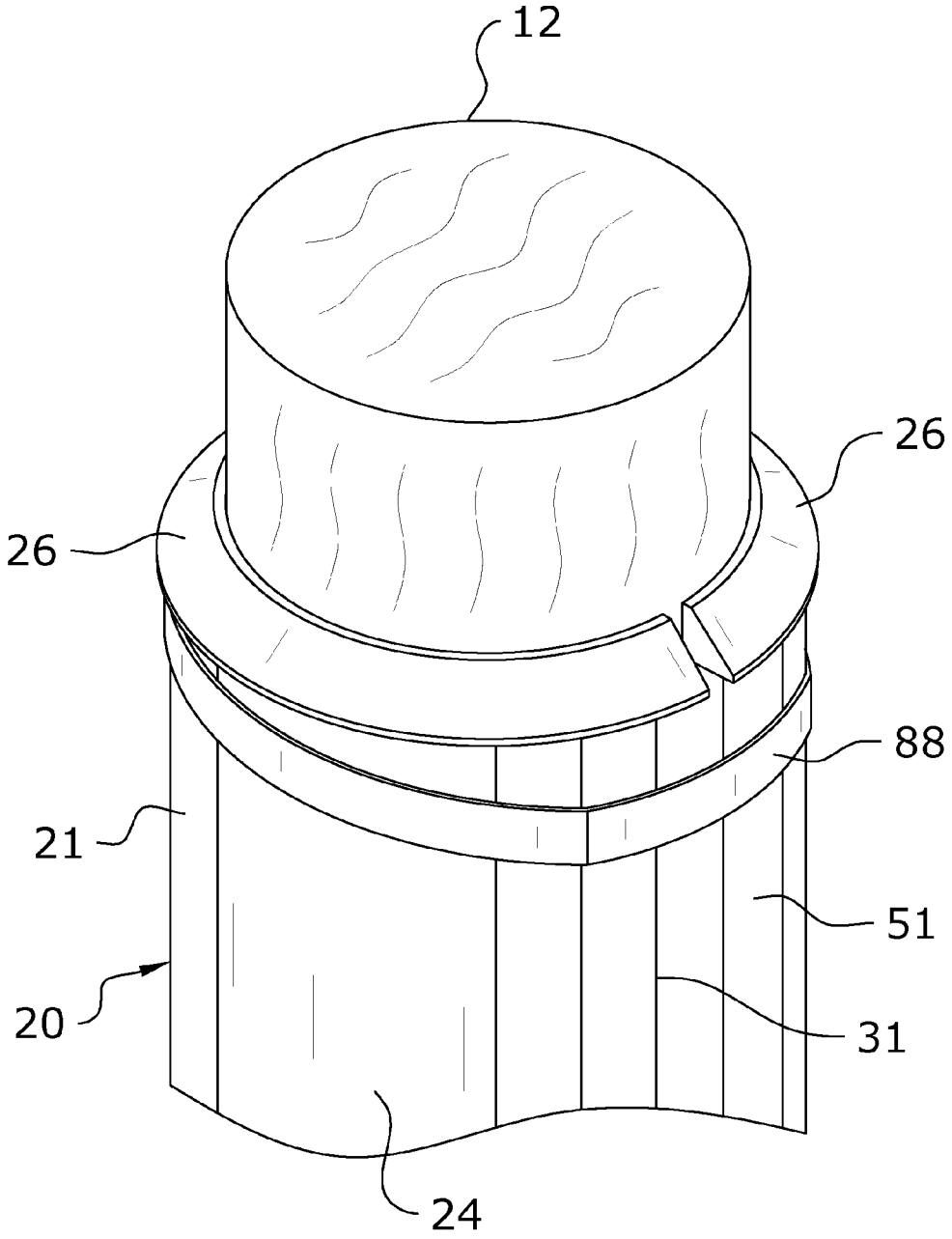
FIG. 23 is an upper perspective view of a sleeve cap installed onto the present invention.
Figure 24:
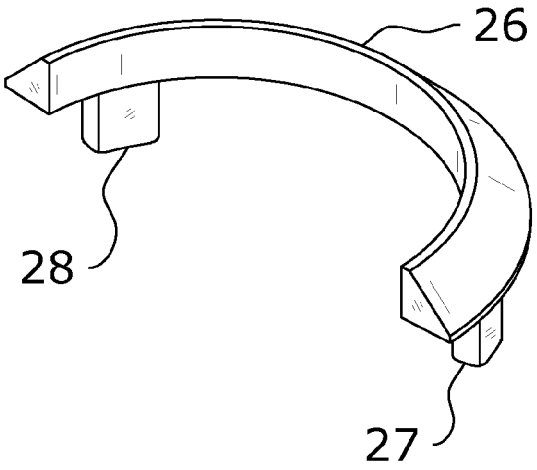
FIG. 24 is an upper perspective view of an alternate sleeve cap of the present invention.
Figure 25:
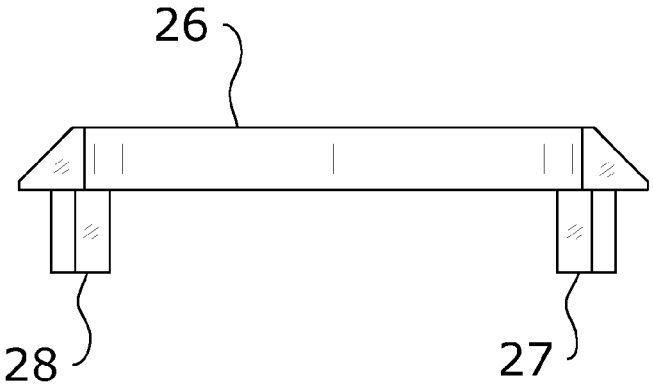
FIG. 25 is a frontal view of an alternate sleeve cap of the present invention.
Figure 26:
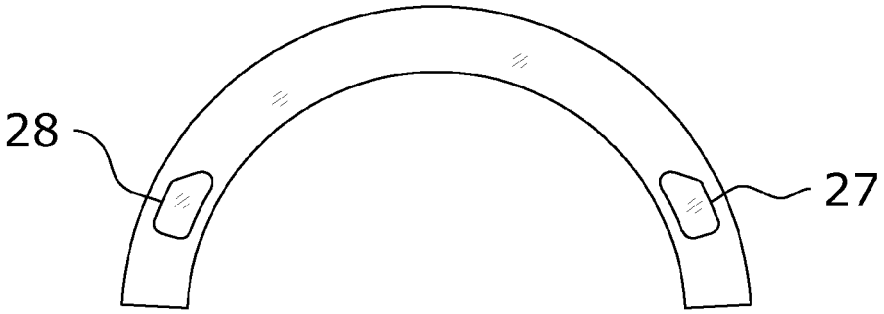
FIG. 26 is a top view of an alternate sleeve cap of the present invention.

As shown throughout the figures, the present invention includes a sleeve assembly 20 which is adapted to be secured around a pole 12 to reinforce the pole 12 from damage. The sleeve assembly is preferably flexible to withstand load, such as wind or other forces while maintaining strength characteristics. As best shown in FIG. 3, the sleeve assembly 20 will preferably comprise two or more sleeves 21, 40 which are positioned to surround the pole 12, though one sleeve may be utilized. If the sleeve assembly consists of two sleeves, the two sleeves 21, 40 of the sleeve assembly 20 could mirror each other as shown in the figures or could comprise alternate configurations. A configuration in which the sleeve assembly 20 consists only of a first sleeve 21 is shown in FIG. 13.

Various types of materials may be utilized for the sleeve assembly 20. Due to the below-grade installation of the present invention, lighter weight composite materials may be utilized for reinforcement such as fibers and poly resin. However, any type of material may be utilized for the sleeve assembly 20, ranging from light-weight materials such as polymers to heavier-weight materials such as metals. Fibers utilized may include glass, basalt, aramid, carbon, and organic fibers. Poly resins utilized may include polyesters, vinyl esters, epoxies, polyurethane chemistries, and mixtures thereof. The material used may comprise a non-homogenous substrate. However, the scope of the present invention should not be construed as limited to any particular material.

Portions of the sleeve assembly 20 which are exposed to the elements and sun may be coated to prevent surface degradation and fiber blooming. Coatings may be applied by powder coating, liquid-spray coating, or thermoplastic cross head extruded processes. Coating materials may include polyesters, polyurethane, acrylic resins, blends, or other UV-resistant materials.

The structure, configuration, orientation, and number of sleeves 21, 40 comprising the sleeve assembly 20 may vary in different embodiments. Although the figures illustrate that the first sleeve 21 and the second sleeve 40 of the sleeve assembly 20 are removably connected to each other, they may be fixedly attached in some embodiments, such as via a hinge such that the second sleeve 40 can swing open and away from the first sleeve 21. It is preferable that the sleeve assembly 20 be adapted to open and close to ease installation around a pole 12 or removal from a pole 12.

The figures illustrate the sleeve assembly 20 comprising a first sleeve 21 and a second sleeve 40 which are removably secured around a pole 12 via one or more connectors 80. FIGS. 1-11 illustrate an embodiment in which the first sleeve 21 and second sleeve 40 are removably connected to each other around the pole 12. FIGS. 12 and 14-16 illustrate an embodiment in which the first sleeve 21 and second sleeve 40 are not connected to each other, but are nonetheless secured around the pole 12. FIG. 13 illustrates an embodiment in which the sleeve assembly 20 only comprises a first sleeve 21. It should be appreciated that the portions 21, 40 of the sleeve 20 may be fixedly connected to each other, removably connected to each other, or not connected to each other at all.

FIG. 3 best illustrates the first sleeve 21 and the second sleeve 40 of the sleeve assembly 20. The first sleeve 21 is positioned to cover a first radial half of the pole 12 and the second sleeve 40 is positioned to cover a second radial half of the pole 12, with the assembled and installed sleeve substantially or fully surrounding the pole 12. The first and second sleeves 21, 40 may comprise substantially the same structure or may comprise different structures which fit together.

The first sleeve 21 of the sleeve assembly 20 includes a first upper end 22, a first lower end 23, a first outer surface 24, and a first inner surface 25. The first lower end 23 of the first sleeve 21 will generally be positioned below-grade when the present invention is installed. The first upper end 22 of the first sleeve 21 is generally above-grade when the present invention is installed. The first inner surface 25 faces toward and abuts against the pole 12 while the first outer surface 24 faces away from the pole 12.

The first sleeve 21 of the sleeve assembly 20 also includes a first outer edge 30 and a second outer edge 31. Either of the outer edges 30, 31 of the first sleeve 21 may be hingedly or otherwise connected to the second sleeve 40. In the embodiment shown in the figures, the first outer edge 30 and second outer edge 31 of the first sleeve 21 each removably connect with the second sleeve 40.

Figure 6:
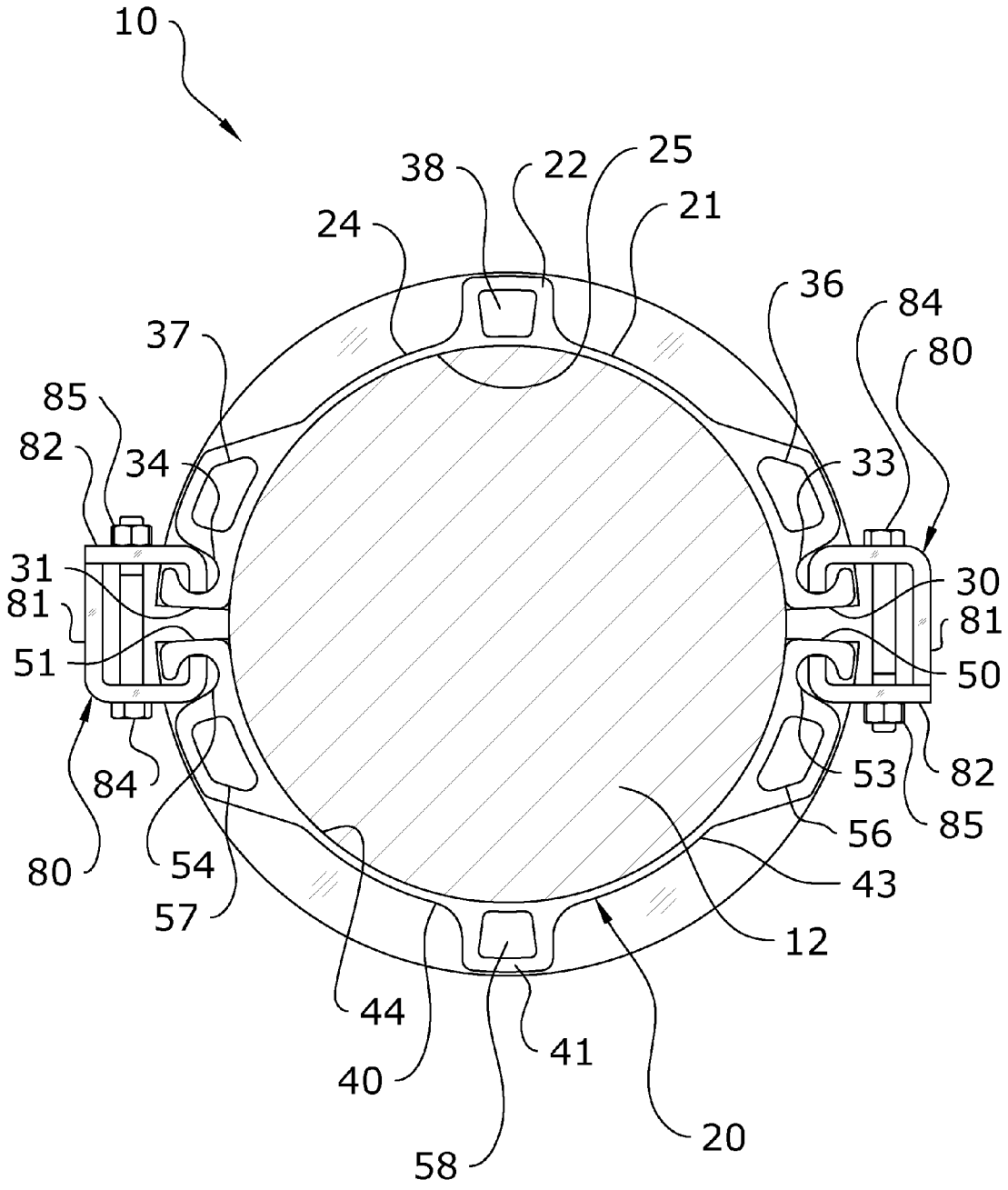
FIG. 6 is a top view of the present invention.
Figure 7:
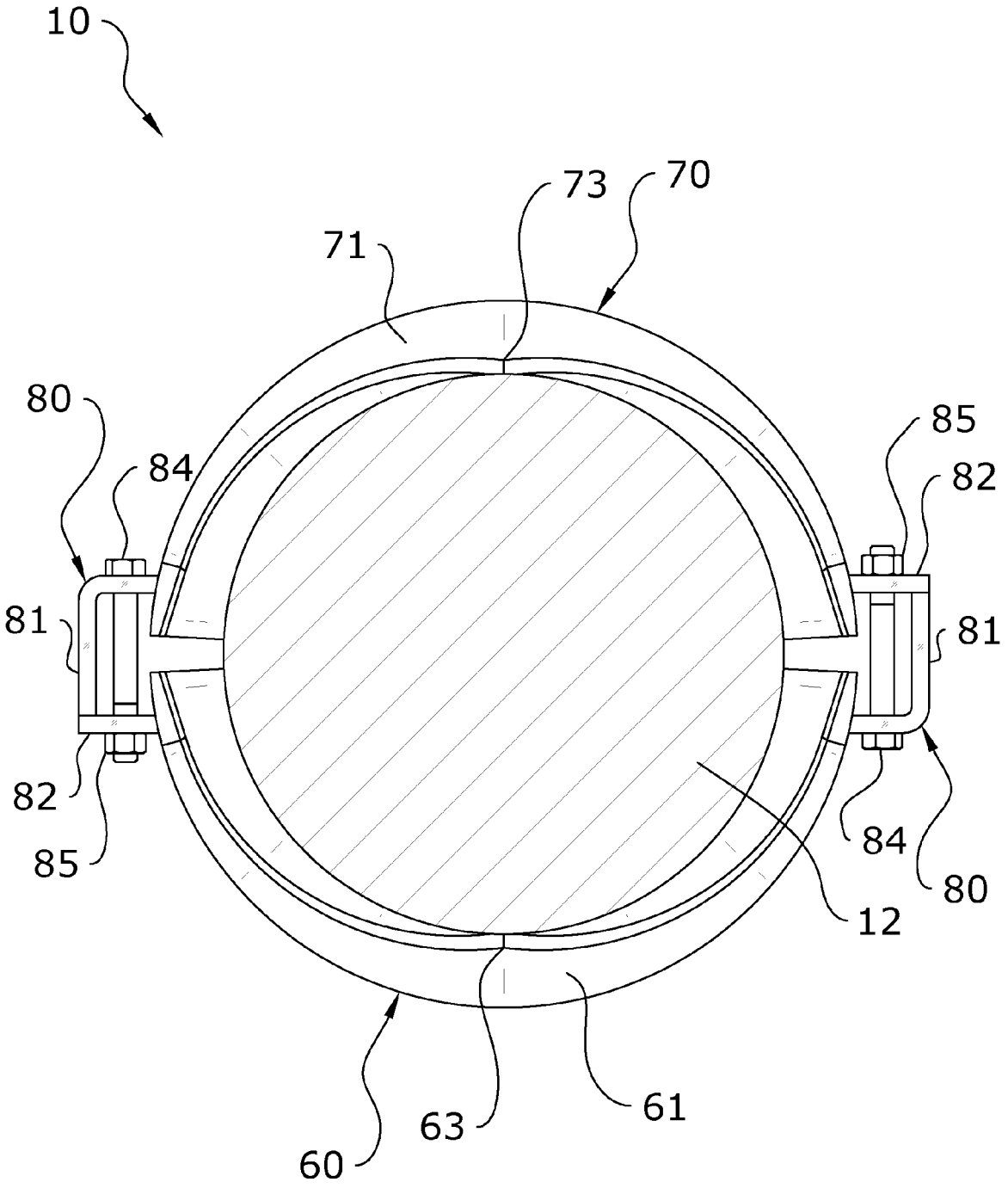
FIG. 7 is a bottom view of the present invention.
Figure 8:
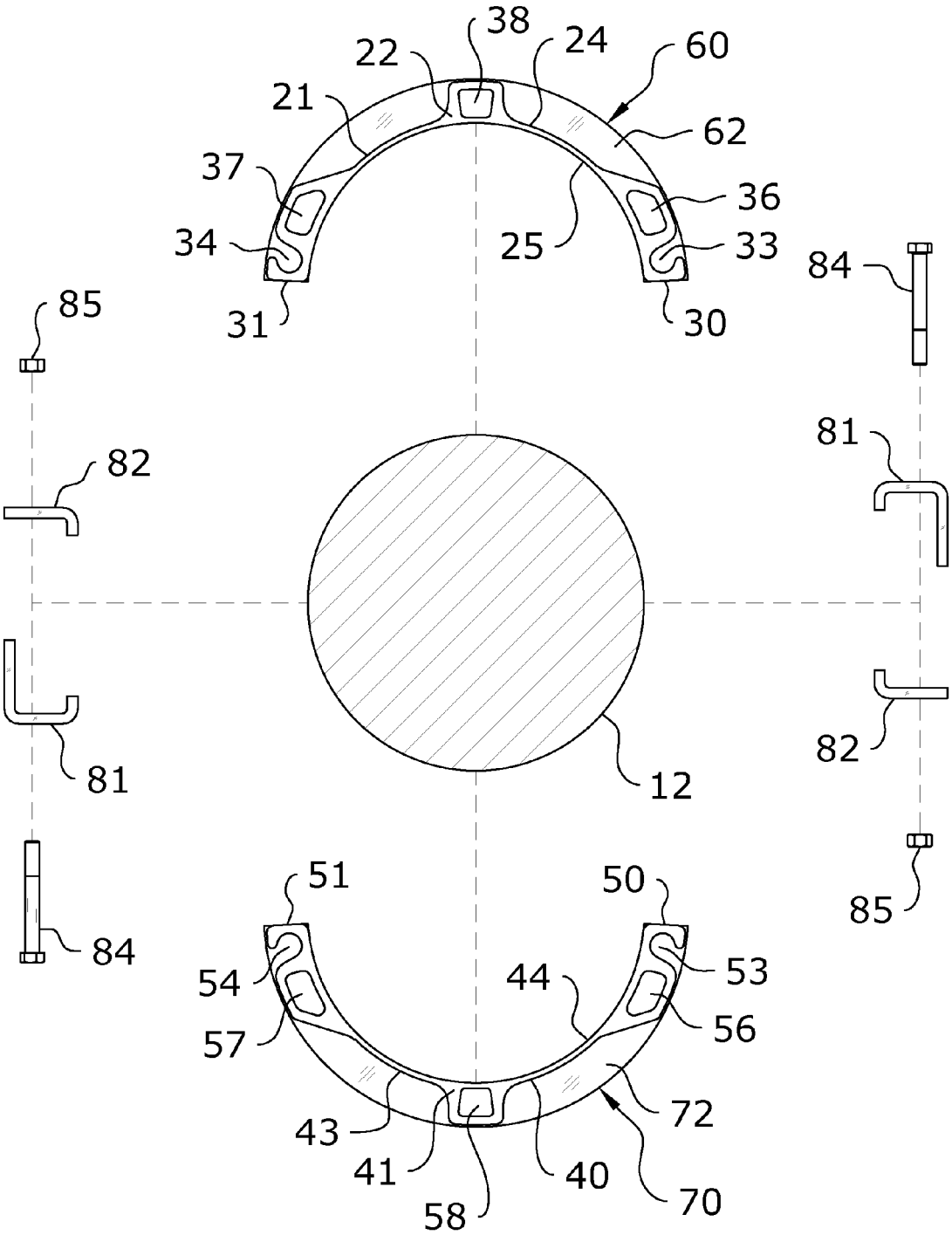
FIG. 8 is a top sectional exploded view of the present invention.

The first sleeve 21 of the sleeve assembly 20 may include a first receiver slot 33 and a second receiver slot 34, each extending between the first upper end 22 and the first lower end 23 along the first outer surface 24 as best shown in FIG. 6. In embodiments which utilize retainers 80 comprising brackets 81, 82, the first receiver slot 33 will act as a mounting point for the retainers 80 on the first sleeve 21 of the sleeve assembly 20 by defining a pair of side walls with which the retainers 80 may engage as shown in FIG. 6.

Figure 4:
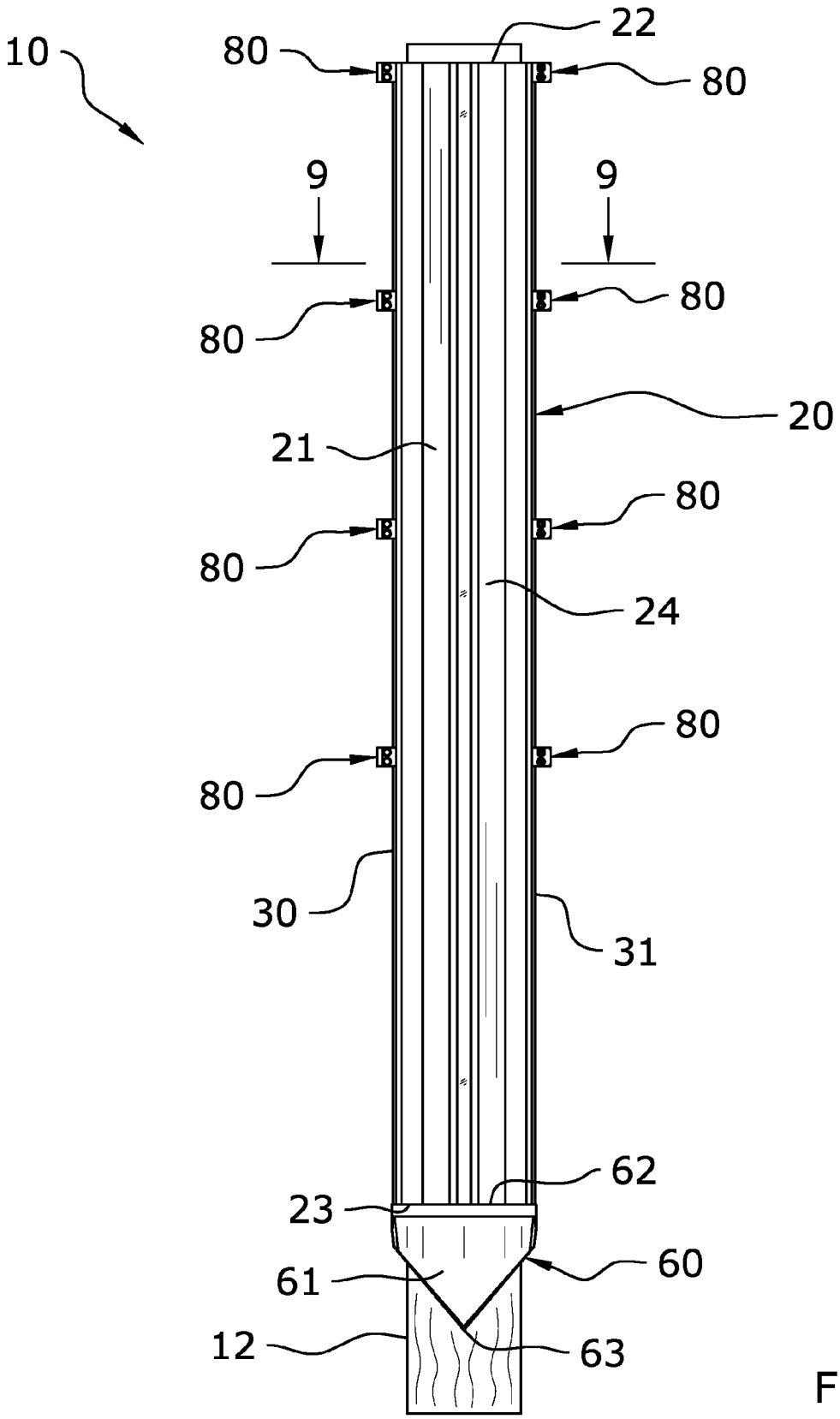
FIG. 4 is a frontal view of the present invention.
Figure 5:
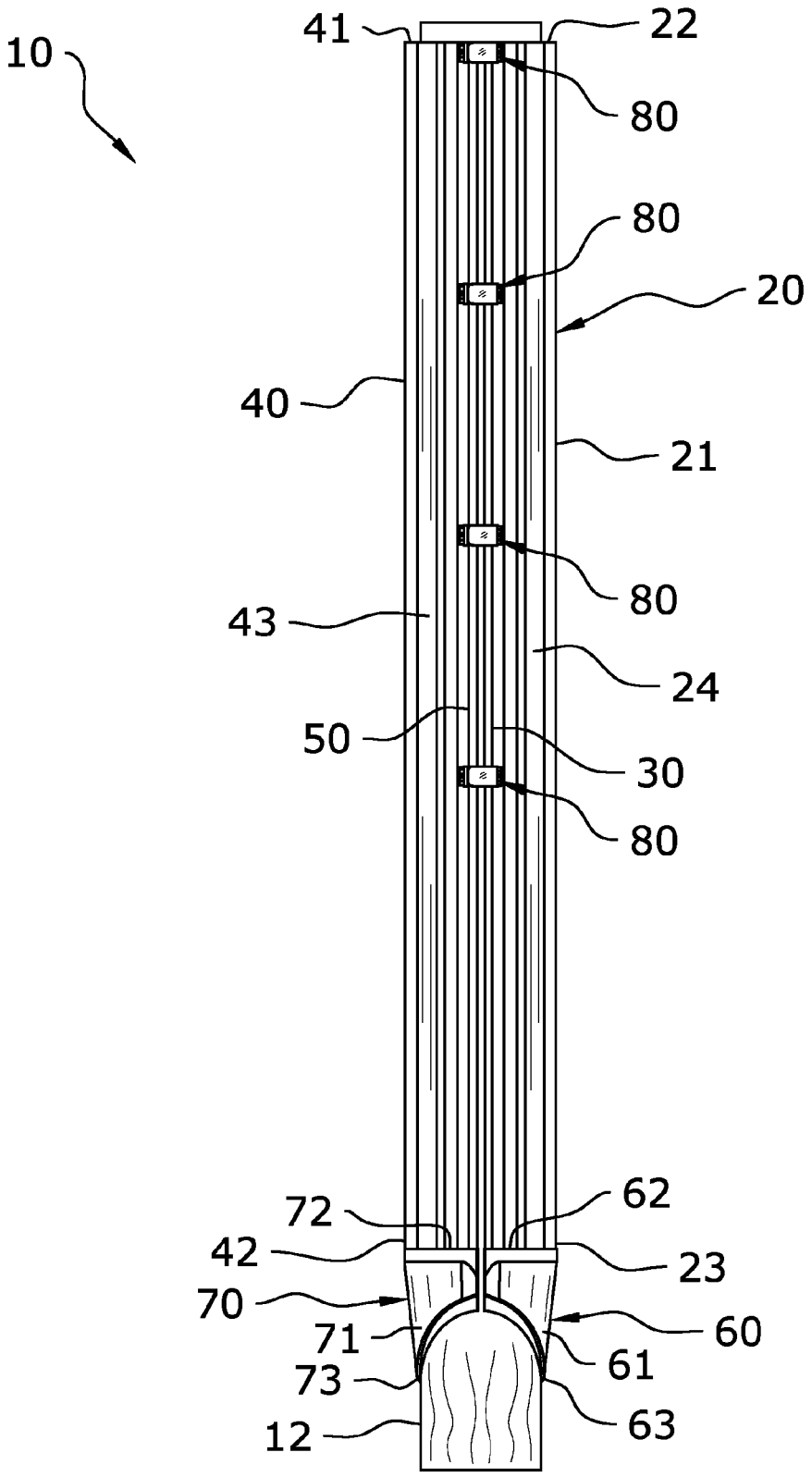
FIG. 5 is a side view of the present invention.

The first sleeve 21 of the sleeve assembly 20 may also include a first receiver channel or hollow 36, a second receiver channel or hollow 37, and/or a third receiver channel or hollow 38. The receiver channels or hollows 36, 37, 38 extend through the first sleeve 21 of the sleeve assembly 20 and as such are preferably full enclosed as shown in the figures. When connecting the sleeve assembly 20 to the insertion attachments 60, 70, the connectors 64, 65 of the first insertion attachment 60 will slide into the receiver channels or hollows 36, 37 as shown in FIGS. 3-4.

The second sleeve 40 of the sleeve assembly 20 includes a second upper end 41, a second lower end 42, a second outer surface 43, and a second inner surface 44. The second lower end 42 of the second sleeve 40 will generally be positioned below-grade when the present invention is installed. The second upper end 41 of the second sleeve 40 is generally above-grade when the present invention is installed. The second inner surface 44 faces toward and abuts against the pole 12 while the second outer surface 43 faces away from the pole 12.

The second sleeve 40 of the sleeve assembly 20 also includes a third outer edge 50 and a fourth outer edge 51. Either of the outer edges 50, 51 of the second sleeve 40 may be hingedly or otherwise connected to the first sleeve 21. In the embodiment shown in the figures, the third outer edge 50 and fourth outer edge 51 of the second sleeve 40 each removably connect with the first sleeve 21.

Figure 9:
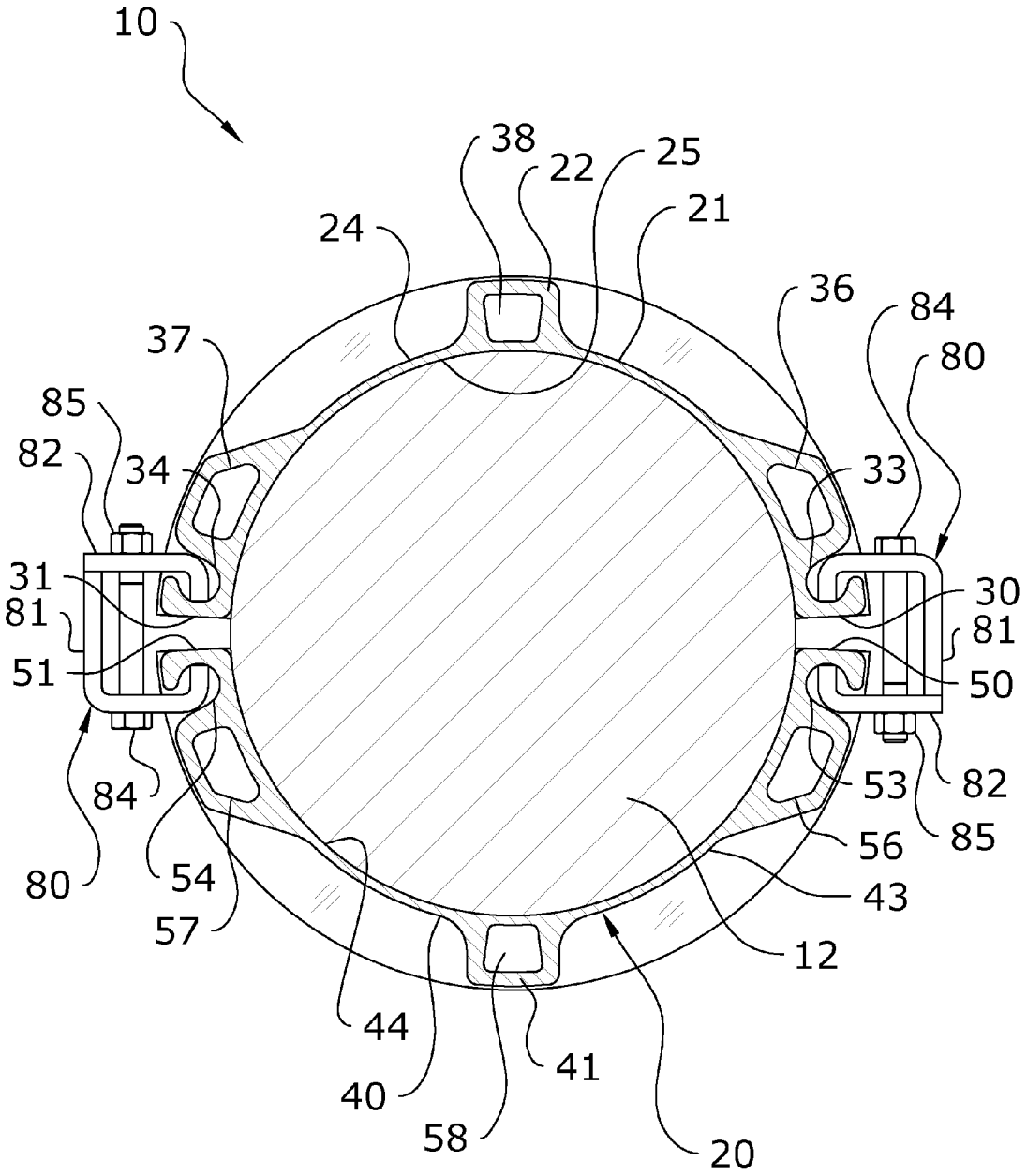
FIG. 9 is a top sectional view of the present invention.

The second sleeve 40 of the sleeve assembly 20 may include a third receiver slot 53 and a fourth receiver slot 54, each extending between the second upper end 41 and the second lower end 42 along the second outer surface 43 of the second sleeve 40 as best shown in FIG. 9. In embodiments which utilize retainers 80 comprising brackets 81, 82, the third receiver slot 53 will act as a mounting point for the retainers 80 on the second sleeve 40 of the sleeve assembly 20 by defining a pair of side walls with which the retainers 80 may engage as shown in FIG. 9.

The second sleeve 40 of the sleeve assembly 20 may also include a third receiver channel or hollow 56, a fourth receiver channel or hollow 57, and/or a fifth receiver channel or hollow 58. The receiver channels or hollow 56, 57, 58 extend through the second sleeve 40 of the sleeve assembly 20 and as such are preferably full enclosed as shown in the figures. When connecting the sleeve assembly 20 to the insertion attachments 60, 70, the connectors 74, 75 of the second insertion attachment 70 will slide into the receiver channels or hollows 56, 57.

C. Insertion Attachments

Figure 2:
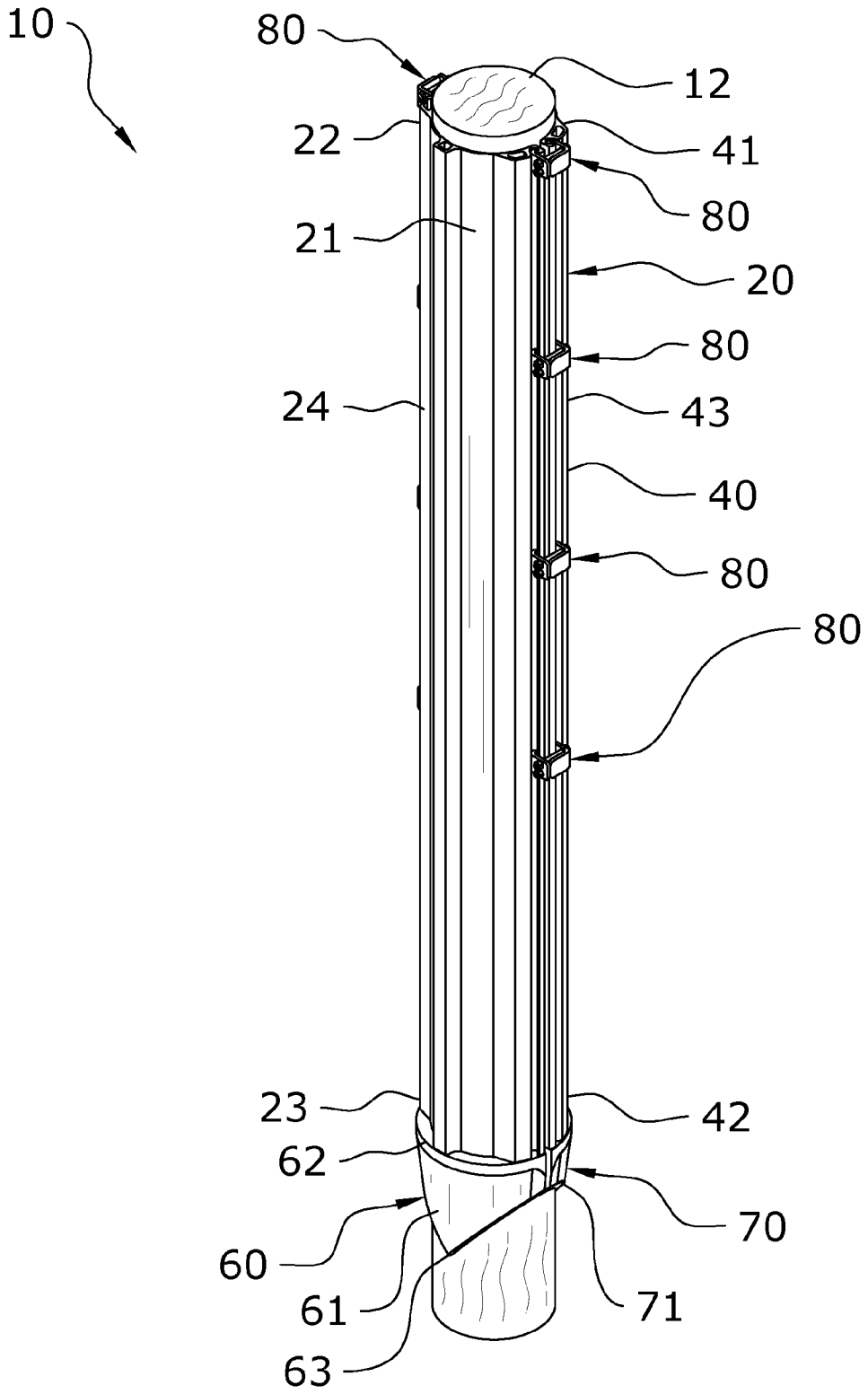
FIG. 2 is an upper perspective view of the present invention installed around a pole.

The present invention utilizes removable insertion attachments 60, 70 to aid in securing the lower ends 23, 42 of the sleeve assembly 20 below-grade. Exemplary illustrations of the insertion attachments 60, 70 are best shown in FIG. 3. As shown therein, the first insertion attachment 60 removably connects to the first lower end 23 of the first sleeve 21 of the sleeve assembly 20. Thus, as shown in FIG. 2, the first insertion attachment 60 is connected to the first sleeve 21 only at the lower end 23 of the first sleeve. The second insertion attachment 70 removably connects to the second lower end 42 of the second sleeve 40 of the sleeve assembly 20. Thus, as shown in FIG. 2, the second insertion attachment 70 is connected to the second sleeve 40 only at the lower end 42 of the second sleeve.

The insertion attachments 60, 70 may comprise various materials, such as fibers, poly resins and metals. The insertion attachments 60, 70 are preferably rigid to withstand contact with ground surface. The insertion attachments 60, 70 may be connected to the sleeve assembly 20 through the use of mechanical and/or chemical fasteners as discussed herein.

Although the figures illustrate the use of two insertion attachments 60, 70 comprising a first insertion attachment 60 for the first sleeve 21 and a second insertion attachment 70 for the second sleeve 40, it should be appreciated that alternate embodiments may be more or less insertion attachments 60, 70 depending on the application of that embodiment of the present invention.

As best shown in FIG. 3, the first insertion attachment 60 is removably connected to the first sleeve 21 of the sleeve assembly 20. The first insertion attachment 60 comprises a first blade 61 which may comprise any structure or configuration which aids in digging or inserting into a ground surface. In the embodiment shown in the figures, the first blade 61 comprises a tapering structure from its upper end 62 to its lower end 63, with the lower end 63 of the first blade 61 coming to a point as shown in FIG. 4.

The upper end 62 of the first blade 61 may be comprised of a semi-circular structure as shown in the figures, or may comprise alternate structures. Preferably, the overall inner surface of the first blade 61 will have a shape to match the shape of the outer surface of the post 12. In most cases, the inner surface of the first blade 61 will be curved and comprise a semi-circular shape as shown in the figures, though other shapes may be utilized to match alternately-shaped posts 12. This will ensure a tight fit between the inner surface of the first blade 61 and the outer surface of the post 12.

FIG. 3 also illustrates a second insertion attachment 70 which is removably connected to the second sleeve 40 of the sleeve assembly 20. The second insertion attachment 70 comprises a second blade 71 which may comprise any structure or configuration which aids in digging or inserting into a ground surface. In the embodiment shown in the figures, the second blade 71 comprises a tapering structure from its upper end 72 to its lower end 73, with the lower end 73 of the second blade 71 coming to a point as shown in FIG. 4.

The upper end 72 of the second blade 71 may be comprised of a semi-circular structure as shown in the figures, or may comprise alternate structures. Preferably, the overall inner surface of the second blade 71 will have a shape to match the shape of the outer surface of the post 12. In most cases, the inner surface of the second blade 71 will be curved and comprise a semi-circular shape as shown in the figures, though other shapes may be utilized to match alternately-shaped posts 12. This will ensure a tight fit between the inner surface of the second blade 71 and the outer surface of the post 12.

Preferably, the shape and structure of the first insertion attachment 60 including the first blade 61 will mirror the shape and structure of the second insertion attachment 70 including the second blade 71. With such a configuration, the first blade 61 and second blade 71 will be installed close together at their respective outer edges to substantially enclose the post 12 as best shown in FIG. 2. It should be appreciated, however, that the blades 61, 71 need not contact each other after installation as shown in the figures.

As shown in FIG. 3, the first insertion attachment 60 will generally include one or more connectors 64, 65 at or near its upper end 62. The connectors 64, 65 are utilized to connect the first insertion attachment 60 to the first lower end 23 of the first sleeve 21 of the sleeve assembly 20.

In a preferred embodiment as shown in the figures, the connectors 64, 65 comprise a first connector 64 extending from a point at or near a first end of the upper end 62 of the first insertion attachment 60 and a second connector 65 extending from a point at or near a second end of the upper end 62 of the first insertion attachment 60. However, the connectors 64, 65 need not be on opposite ends of the first insertion attachment 60 and need not be spaced-apart in alternate embodiments. Additionally, more or less connectors 64, 65 may be utilized. For example, some embodiments may utilize a single first connector 64 which extends from a central point along the upper end 62 of the first insertion attachment 60.

As shown in FIG. 3, the second insertion attachment 70 will generally include one or more connectors 74, 75 at or near its upper end 72. The connectors 74, 75 are utilized to connect the second insertion attachment 70 to the second lower end 42 of the second sleeve 40 of the sleeve assembly 20.

In a preferred embodiment as shown in the figures, the connectors 74, 75 comprise a third connector 74 extending from a point at or near a first end of the upper end 72 of the second insertion attachment 70 and a fourth connector 75 extending from a point at or near a second end of the upper end 72 of the second insertion attachment 70. However, the connectors 74, 75 need not be on opposite ends of the second insertion attachment 70 and need not be spaced-apart in alternate embodiments. Additionally, more or less connectors 74, 75 may be utilized. For example, some embodiments may utilize a single third connector 74 which extends from a central point along the upper end 72 of the second insertion attachment 70.

The structure, configuration, orientation, and number of connectors 64, 65, 74, 75 may vary in different embodiments of the present invention. In the exemplary embodiment shown in the figures, each of the connectors 64, 65, 74, 75 comprises an elongated rod extending upwardly from the respective insertion attachment 60, 70; with each of the connectors 64, 65, 74, 75 being adapted to be inserted within a receiver channel or hollow 36, 37, 38, 56, 57, 58 of the sleeve assembly 20. The connectors 64, 65, 74, 75 may frictionally engage with the receiver channels or hollows 36, 37, 38, 56, 57, 58 or be secured therein by other means such as clamps, adhesives, mechanical fasteners, or the like. In some embodiments, discrete connectors 64, 65, 74, 75 may be omitted entirely and instead an adhesive (such as chemical adhesives) may be utilized to secure the insertion attachments 60, 70 to the sleeve assembly 20.

D. Retainers

As shown throughout the figures, retainers 80 are utilized to secure the sleeve assembly 20 around the pole 12 and, in some embodiments, to secure the first and second sleeves 21, 40 of the sleeve assembly 20 with each other. Any type of retainer 80 known to secure a sleeve assembly 20 around a pole 12 may be utilized. FIGS. 1-11 illustrate an embodiment in which the retainers 80 comprise brackets 81, 82 which are interconnected via fasteners 84 and nuts 85. FIGS. 12-16 illustrate an embodiment in which the retainers 80 comprise securing bands 88 which extend around the sleeve assembly 20.

As shown in FIGS. 1-11, one embodiment of the present invention utilizes brackets 81, 82 which connect the first and second sleeves 21, 40 of the sleeve assembly 20 together around the pole 12. Such an embodiment utilizes a retainer 80 which comprises a first bracket 81 comprising a substantially L-shaped structure which secures to either of the receiver slots 33, 34 of the first sleeve 21 of the sleeve assembly 20 and a second bracket 82 comprising a substantially L-shaped structure which secures to either of the receiver slots 53, 54 of the second sleeve 40 of the sleeve assembly 20.

Figure 10:
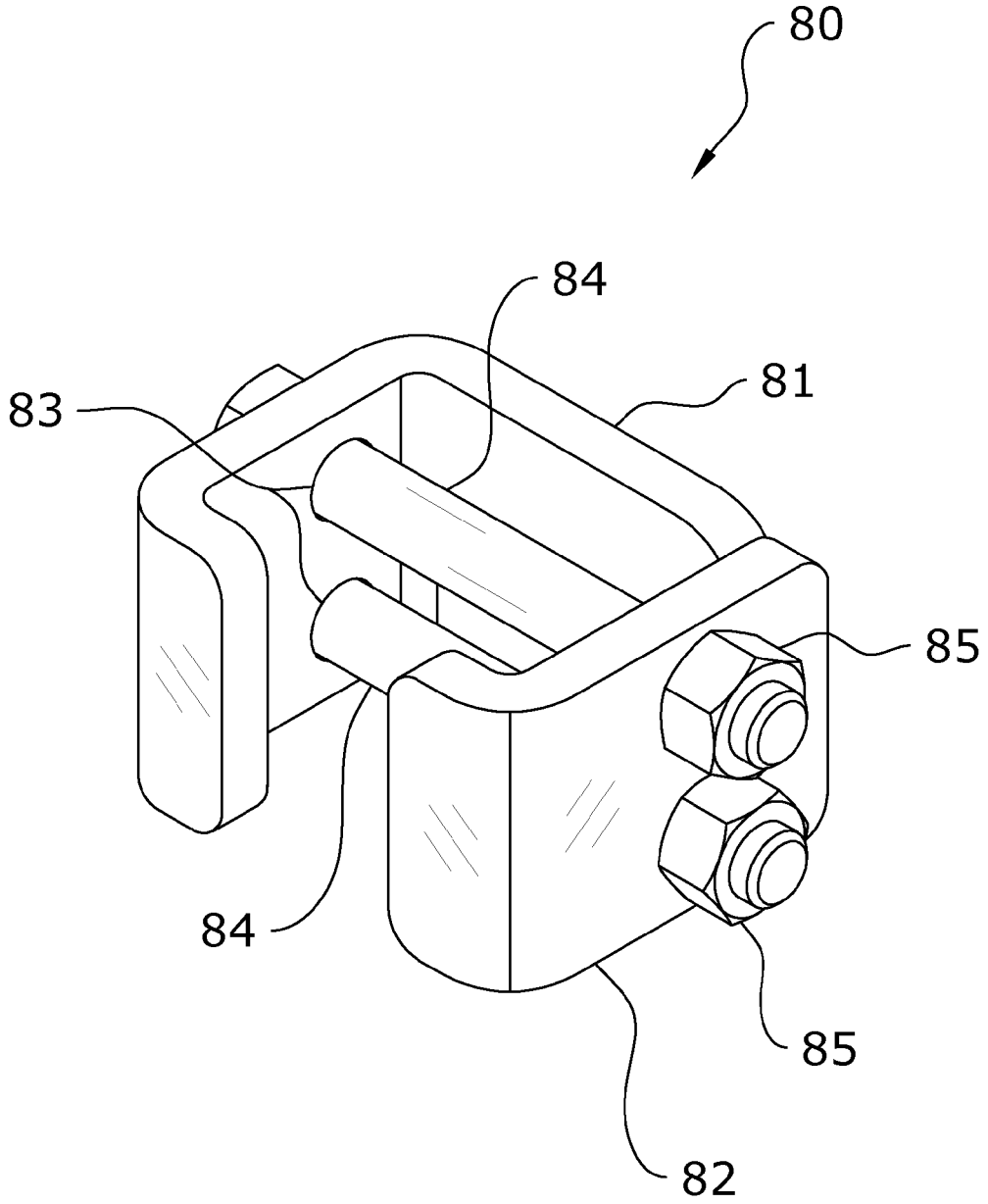
FIG. 10 is an upper perspective view of a retainer of the present invention.
Figure 11:
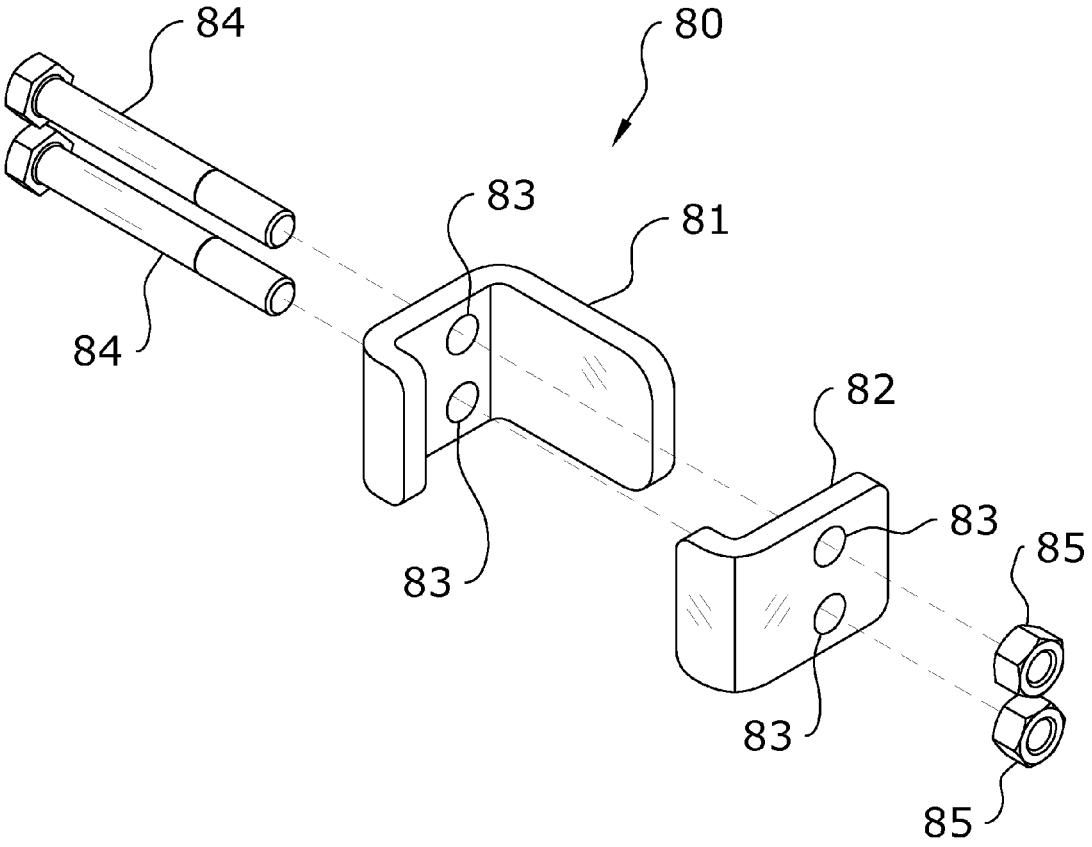
FIG. 11 is an exploded upper perspective view of a retainer of the present invention.
Figure 12:
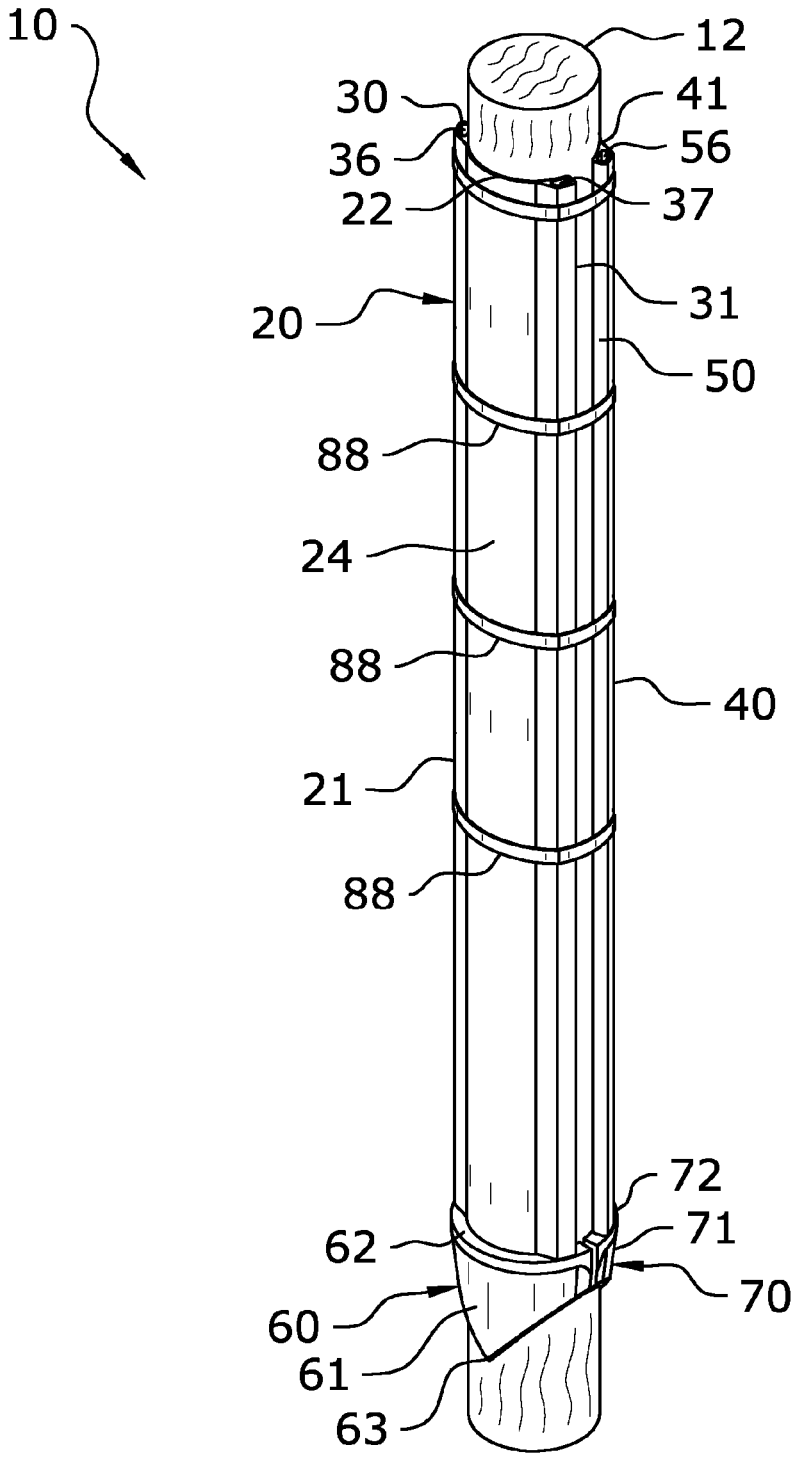
FIG. 12 is an upper perspective view of an alternate retainer being used on the present invention.

Each of the brackets 81, 82 includes one or more apertures 83 through which fasteners 84 may be extended to tighten the brackets 81, 82 against each other and thus firmly secure the first and second sleeves 21, 40 of the sleeve assembly 20 to each other and around the pole 12. Nuts 85 may be utilized to secure the fasteners 84 in place as shown in FIG. 10.

In the embodiment shown in the figures, a first retainer 80 connects between the first receiver slot 33 of the first sleeve 21 and the third receiver slot 53 of the second sleeve 40 while a second retainer 80 connects between the second receiver slot 34 of the first sleeve 21 and the fourth receiver slot 54 of the second sleeve 40. Such a configuration ensures that the sleeve assembly 20 is tightly fitted around the pole 12. The retainers 80 may be adjusted in tightness by tightening or loosening the fasteners 84 with the nuts 85.

As shown in FIGS. 12-16, the retainers 80 may comprise securing bands 88 in some embodiments of the present invention. In such embodiments, one or more securing bands 88 are tightened around the sleeve assembly 20 at various positions along its length. In such an embodiment using securing bands 88, the two sleeves 21, 40 of the sleeve assembly 20 need not be directly connected to each other.

The number of retainers 80 utilized, whether the bracket configuration or the band configuration, will vary in different embodiments depending on the length of the sleeve assembly 20 being used. Further, the positioning and spacing of the retainers 80 may vary in different embodiments for different applications.

E. Operation of Preferred Embodiment

In use, the sleeve assembly 20 is first fitted with the insertion attachments 60, 70 if the insertion attachments 60, 70 were not already pre-installed or integrally formed with the sleeve assembly 20, such as by friction fitting, adhesives, clamps, mechanical fasteners, or the like. In either case, prior to use of the present invention, the first insertion attachment 60 is secured to (or integral with) the first sleeve 21 and the second insertion attachment 70 is secured to (or integral with) the second sleeve 40.

The insertion attachments 60, 70 aid with below-grade installment of the sleeve assembly 20, which eases installation and provides for much stronger reinforcement than would be possible with only above-grade installations. The blades 61, 71 of the insertion attachments 60, 70 act to push dirt or other ground material out of the way and to aid in driving the insertion attachments 60, 70 underneath the surface. The depth at which the insertion attachments 60, 70 are installed around the pole 12 will vary for different applications of the present invention. Thus, the exemplary figures should not be construed as limiting on the scope of the present invention, as the insertion attachments 60, 70 may be positioned above or below the placement shown in the exemplary figures.

The method of driving the insertion attachments 60, 70 below-grade along with the sleeve assembly 20 will vary depending on the tools available to the user as well as the type and density of the ground material surrounding the pole 12. For less dense ground surfaces such as sand, one may install the sleeve assembly 20 by hand by firmly grasping the insertion attachments 60, 70 at their upper ends 62, 72 and pushing them into the ground surrounding the pole 12. The blades 61, 71 will aid displacing the ground surface to more easily drive the insertion attachments 60, 70 underground.

For denser ground, tools may be utilized to aid with installation of the insertion attachments 60, 70 underground. For example, hammers, sledgehammers, jackhammers, or any other mechanized or hand-held tool may be utilized for driving the insertion attachments 60, 70 beneath the ground. In the case of a hammer, the hammer would be repeatedly hit onto the upper ends 62, 72 of the insertion attachments 60, 70 to drive them below-grade. As seen throughout the figures, the upper ends 62, 72 of the insertion attachments 60, 70 extend slightly outwardly from the outer circumference of the sleeve assembly 20 to form a lip. Thus, the lips of the upper ends 62, 72 provide a striking point for a tool or implement, as well as a grasping point for the hands if the sleeve assembly 20 is hand-driven as discussed above. Downwardly-projecting force applied to the lips of the upper ends 62, 72 is operable to drive the insertion attachments 60, 70 into the ground surface. Any type of handheld or mechanized tool could be utilized so long as it applies a downward driving force to the insertion attachments 60, 70 to drive them into the ground.

For particularly dense ground or if time is of the essence, a skid steer with attached implement may be utilized to drive the insertion attachments 60, 70 underground. Such an implement could comprise a hammer or other mechanism capable of providing a forceful impact on the upper ends 62, 72 of the insertion attachments 60, 70. By attaching such an implement to a skid steer, such as to a bucket or to its arms, one can apply direct force to the upper ends 62, 72 insertion attachments 60, 70 with the implement to drive them underground in a quick and efficient manner.

With the sleeve assembly 20 secured to the insertion attachments 60, 70 to surround the pole 12, one or more retainers 80 may be secured around the sleeve assembly 20 to tighten it around the pole 12 and ensure proper reinforcement. In the embodiment shown in FIGS. 1-11 wherein the retainers 80 comprise brackets 81, 82, this is accomplished by securing the first bracket 81 between the first receiver slot 33 of the first sleeve 21 and the third receiver slot 53 of the second sleeve 40 and tightening with fasteners 84 and nuts 85.

Similarly, the second bracket 82 is secured between the second receiver slot 34 of the first sleeve 21 and the fourth receiver slot 54 of the second sleeve 40, then tightened using fasteners 84 and nuts 85. After tightening the brackets 81, 82, the first and second sleeves 21, 40 of the sleeve assembly 20 are both connected to each other as well as being firmly positioned around the pole 12 to provide reinforcement thereto. The number of retainers 80 utilized will vary depending on the embodiment of the invention being utilized.

In the embodiment shown in FIGS. 12-16, wherein the retainers 80 comprise securing bands 88, the securing bands 88 are simply tightened around the sleeve assembly 20 to cover both the first and second sleeves 21, 40 thereof. A number of securing bands 88 may be utilized along the length of the sleeve assembly 20 to provide further reinforcement of the pole 12.

As best shown in FIGS. 17-26, after full installation of the sleeve assembly 20 around the pole 12 and the retainers 80 to secure the sleeve assembly 20, an optional sleeve cap 26 may be installed to cover the receiver channels or hollows 36, 37, 38, 56, 57, 58 at the respective upper ends 22, 41 of the first and second sleeves 21, 40 of the sleeve assembly 20. Each of the sleeve caps 26 comprises a semi-circular arc from which extends one or more extensions. In the figures, the sleeve cap 26 is illustrated as comprising a first extension 27 to be inserted into the first receiver channel 36, a second extension 28 to be inserted into the second receiver channel 37, and a third extension 29 to be inserted into the third receiver channel or hollows 38. Use of such a sleeve cap 26 will prevent water or other elements from flowing down the channels or hollows 36, 37, 38, 56, 57, 58 and potentially compromising the pole 12 or its reinforcement.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A pole reinforcement system, comprising:

a sleeve for installation around a pole, said sleeve formed of a composite material comprising poly resin and fibers;

an insertion attachment removably connected to said sleeve only at a lower end of said sleeve, wherein said insertion attachment includes a blade for displacing a ground surface around said pole, said blade having an inner surface that is curved and that has a semi-circular shape, said blade having an upper end and a lower end, said blade tapering from its upper end to its lower end with its lower end coming to a point, said insertion attachment extending outwardly from an outer circumference of said sleeve to define a lip, said lip configured to provide a driving point such that downward force applied to said lip drives said insertion attachment into the ground whereby said insertion attachment pulls said sleeve downwardly; and at least one retainer for securing said sleeve around said pole.

2. The pole reinforcement system of claim 1, wherein said at least one retainer comprises one or more bands.

3. The pole reinforcement system of claim 1, wherein said insertion attachment includes a first connector extending upwardly therefrom.

4. The pole reinforcement system of claim 1, including at least one connector for connecting said insertion attachment to said sleeve.

5. The pole reinforcement system of claim 4, wherein said at least one connector comprises at least one fastener.

6. The pole reinforcement system of claim 4, wherein said sleeve includes at least one receiver channel adapted to receive said at least one connector.

7. The pole reinforcement system of claim 6, wherein said at least one receiver channel comprises a hollow.

8. The pole reinforcement system of claim 1, wherein said sleeve is flexible, and said insertion attachment is rigid.

9. The pole reinforcement system of claim 1, wherein said sleeve is a non-homogenous substrate.

10. The pole reinforcement system of claim 1, wherein said insertion attachment comprises metal.

11. The pole reinforcement system of claim 1, wherein the pole reinforcement system is devoid of any fastener that extends into the pole.

12. The pole reinforcement system of claim 1, further comprising:

a second sleeve for installation around the pole, said second sleeve formed of the composite material comprising poly resin and fibers;

a second insertion attachment removably connected to said second sleeve only at a lower end of said second sleeve, wherein said second insertion attachment includes a second blade, said second blade having an inner surface that is curved and that has a semi-circular shape, said second blade having an upper end and a lower end, said second blade tapering from its upper end to its lower end with its lower end coming to a point, said second insertion attachment extending outwardly from an outer circumference of said second sleeve to define a second lip, said second lip configured to provide a driving point such that downward force applied to said second lip drives said second insertion attachment into the ground whereby said second insertion attachment pulls said second sleeve downwardly.

13. A pole reinforcement system and a pole, the pole reinforcement system comprising:

a sleeve assembly installed around a pole, wherein said sleeve assembly comprises a first sleeve secured against a first side of said pole, said first sleeve comprising polymer;

a first insertion attachment removably connected to said first sleeve only at a lower end of said first sleeve, wherein said first insertion attachment includes a first blade, said first blade having an inner surface that is curved and that has a semi-circular shape, said first blade having an upper end and a lower end, said first blade tapering from its upper end to its lower end with its lower end coming to a point, said first insertion attachment extending outwardly from an outer circumference of said first sleeve to define a first lip, said first lip configured to provide a driving point such that downward force applied to said first lip drives said first insertion attachment into the ground whereby said first insertion attachment pulls said first sleeve downwardly;

and at least one retainer securing said first sleeve of said sleeve assembly around said pole;

said pole installed in the ground, such that the first insertion attachment is embedded in dirt.

14. The pole reinforcement system of claim 13, wherein said first sleeve of said sleeve assembly includes a first receiver channel extending between an upper end and said lower end thereof.

15. The pole reinforcement system of claim 14, wherein said first insertion attachment includes a first connector extending upwardly therefrom for inserting within said first receiver channel.

16. The pole reinforcement system of claim 13, wherein said sleeve assembly comprises a corrosion-resistant composite material.

17. The pole reinforcement system and pole of claim 13, wherein said first sleeve is flexible, said first insertion attachment being rigid.

18. The pole reinforcement system and pole of claim 13, wherein said first sleeve is a non-homogenous substrate.

19. The pole reinforcement system and pole of claim 13, wherein said first sleeve comprises poly resin and fiber.

20. The pole reinforcement system and pole of claim 13, wherein said first insertion attachment comprises metal.

21. The pole reinforcement system and pole of claim 13, wherein the pole reinforcement system is devoid of any fastener that extends into the pole.

22. The pole reinforcement system and pole of claim 13, wherein the sleeve assembly further comprises a second sleeve secured against a second side of said pole, wherein said first side is opposite of said second side, and the pole reinforcement system further comprises a second insertion attachment removably connected to said second sleeve only at a lower end of said second sleeve, wherein said second insertion attachment includes a second blade, said second blade having an inner surface that is curved and that has a semi-circular shape, said second blade having an upper end and a lower end, said second blade tapering from its upper end to its lower end with its lower end coming to a point, said second insertion attachment extending outwardly from an outer circumference of said second sleeve to define a second lip, said second lip configured to provide a driving point such that downward force applied to said second lip drives said second insertion attachment into the ground whereby said second insertion attachment pulls said second sleeve downwardly, said at least one retainer securing said first and second sleeves of said sleeve assembly around said pole.

23. The pole reinforcement system of claim 22, wherein said second sleeve of said sleeve assembly includes a second receiver channel extending between an upper end and said lower end thereof.

24. The pole reinforcement system of claim 23, wherein said second insertion attachment includes a second connector extending upwardly therefrom for inserting within said second receiver channel.

25. The pole reinforcement system of claim 24, further comprising a first sleeve cap for covering said first receiver channel at said upper end of said first sleeve of said sleeve assembly and a second sleeve cap for covering said second receiver channel at said upper end of said second sleeve of said sleeve assembly.

26. The pole reinforcement system and pole of claim 22, wherein said first sleeve has first and second outer edges configured to removably connect with said second sleeve.

27. The pole reinforcement system and pole of claim 22, wherein said first and second blades have adjacent outer edges and substantially enclose said pole.

* * * * *